US012320347B2

(12) United States Patent
Walsh

(10) Patent No.: US 12,320,347 B2
(45) Date of Patent: Jun. 3, 2025

(54) INTELLIGENT CONTROLLER FOR A RECIPROCATING AIR COMPRESSOR AND METHODS OF USE THEREOF

(71) Applicant: Adam Thomas Walsh, Charlotte, NC (US)

(72) Inventor: Adam Thomas Walsh, Charlotte, NC (US)

(73) Assignee: WAK Devices, LLC, Charlotte, NC (US)

( * ) Notice: Subject to any disclaimer, the term of this patent is extended or adjusted under 35 U.S.C. 154(b) by 0 days.

(21) Appl. No.: 17/809,306

(22) Filed: Jun. 28, 2022

(65) Prior Publication Data

US 2023/0417235 A1 Dec. 28, 2023

(51) Int. Cl.

| | |
|---|---|
| ***F04B 41/02*** | (2006.01) |
| ***F04B 27/24*** | (2006.01) |
| ***F04B 35/04*** | (2006.01) |
| ***F04B 49/00*** | (2006.01) |
| ***F04B 49/02*** | (2006.01) |

(Continued)

(52) U.S. Cl.

CPC ..... *F04B 41/02* (2013.01); *F04B 27/24* (2013.01); *F04B 35/04* (2013.01); *F04B 49/00* (2013.01); *F04B 49/02* (2013.01); *F04B 49/022* (2013.01); *F04B 49/03* (2013.01); *F04B 49/06* (2013.01); *F04B 49/065* (2013.01); *F04B 49/08* (2013.01); *F04B 49/10* (2013.01); *F04B 49/22* (2013.01); *F04B 51/00* (2013.01); *F04C 28/06* (2013.01); *F04C 28/24* (2013.01); *F04B 2205/05* (2013.01); *F04C 2270/80* (2013.01); *F04C 2270/86* (2013.01)

(58) Field of Classification Search

CPC ..... F04B 49/065; F04B 41/02; F04B 49/022; F04B 51/00; F04B 2205/05; F04B 49/02; F04B 49/06; F04B 27/24; F04B 49/00; F04B 49/08; F04B 49/03; F04B 49/10; F04B 35/04; F04B 49/22; F04C 28/06; F04C 28/24; F04C 2270/80; F04C 2270/86

See application file for complete search history.

(56) References Cited

U.S. PATENT DOCUMENTS

| | | | |
|---|---|---|---|
| 4,277,830 | A | 7/1981 | Reid et al. |
| 6,390,779 | B1 | 5/2002 | Cunkelman |

(Continued)

*Primary Examiner* — Peter J Bertheaud

(74) *Attorney, Agent, or Firm* — Jeffrey C. Watson, Esq.; Grell & Watson Patent Attorneys LLC

(57) ABSTRACT

An intelligent controller for a reciprocating air compressor includes a processor, a plurality of sensors, and a plurality of peripheral devices. The plurality of sensors is in communication with the processor. The plurality of sensors is configured to read operating data of the reciprocating air compressor and send that operating data to the processor. The plurality of peripheral devices is in communication with the processor. Each of the plurality of peripheral devices are configured to be controlled by the processor. The plurality of peripheral devices is configured to operatively control the reciprocating air compressor. Wherein, the processor is configured to read data from the plurality of sensors and control the plurality of peripheral devices to intelligently extend life of the reciprocating air compressor and reduce energy consumption of the reciprocating air compressor.

20 Claims, 17 Drawing Sheets

(51) Int. Cl.

| | |
|---|---|
| ***F04B 49/03*** | (2006.01) |
| ***F04B 49/06*** | (2006.01) |
| ***F04B 49/08*** | (2006.01) |
| ***F04B 49/10*** | (2006.01) |
| ***F04B 49/22*** | (2006.01) |
| ***F04B 51/00*** | (2006.01) |
| ***F04C 28/06*** | (2006.01) |
| ***F04C 28/24*** | (2006.01) |

(56) References Cited

U.S. PATENT DOCUMENTS

| | | | | |
|---|---|---|---|---|
| 7,509,233 | B2 | 3/2009 | Pervaiz | |
| 9,762,168 | B2 | 9/2017 | Pham et al. | |
| 9,897,082 | B2 * | 2/2018 | Worden | F04B 27/24 |
| 10,724,462 | B2 | 7/2020 | Burkell et al. | |
| 10,876,487 | B2 | 12/2020 | Park et al. | |

* cited by examiner

INTELLIGENT CONTROLLER FOR A RECIPROCATING AIR COMPRESSOR AND METHODS OF USE THEREOF

FIELD OF THE DISCLOSURE

The present disclosure relates to air compressors, like reciprocating air compressors. More specifically, the present disclosure is directed toward an intelligent controller for a reciprocating air compressor, and methods of use thereof.

BACKGROUND

Generally speaking, an air compressor is a pneumatic device that converts power, using an electric motor, diesel or gasoline engine, etc., into potential energy stored in pressurized air. By one of several methods, an air compressor forces more and more air into a storage tank, increasing the pressure to create the compressed air. When the tank's pressure reaches its engineered upper limit, the air compressor shuts off. The compressed air, then, is held in the tank until called into use. The energy contained in the compressed air can be used for a variety of applications, utilizing the kinetic energy of the air as it is released and the tank depressurizes. When tank pressure reaches its lower limit, the air compressor turns on again by use of a pressure switch, or some pressure-sensing control system, and repressurizes the tank. An air compressor must be differentiated from a liquid pump because it works for any gas/air.

Centrifugal compressors represent the smallest segment of the industrial compressor market. These are large capacity complex machines with motor power greater than 400-hp. These compressors cost over $200 k US and are typically found in very large factories, processing facilities and chemical plants. Electronic controls are standard on centrifugal compressors. Hardware is typically an industrial PLC or similar type unit with display, multiple inputs and outputs. This category of compressor is complex and requires specialized logic and software for the compressor to operate and protect the unit from catastrophic failure. Centrifugal air compressors operate using a target pressure control method that requires the operator to set a desired target pressure. The compressor controller will utilize different methods of modulating output of the compressor in an effort to match demand for compressed air and maintain pressure close to the target pressure. These compressors rarely turn off the motor since large motors over 400 hp require hours of off time before starting so they will unload the compressor instead or operate at a reduced load and discharge excess air to the atmosphere. These are very complex with multiple compressor stages, cooling systems, electrically modulated valves and safety control parameters to monitor. These compressors have sophisticated logic to operate several subsystems in an effort to maintain pressure close to the desired value or within a user defined range and to prevent the compressor from failing.

Rotary screw compressors are a larger segment of the industrial compressor market with medium capacity covering a range from 20-500-hp. These units range in price from $8 k-$150 k. This type of compressor is in most factories worldwide. Rotary style air compressors have used an electronic controller or a combination of electronic and pneumatic controls for the past 30 years. The electronic controller and display panel are mounted within an electrical enclosure. The primary purpose of the controller is to protect the compressor and operate the unit within a user-defined pressure range. The controller hardware sophistication varies based on the size and cost of the air compressor. Rotary screw compressors will typically operate without turning off the motor. The compressor controller will have a user defined upper and lower pressure setting. At the upper pressure value the compressor unloads by closing an inlet valve, reducing the inlet air flow almost 100% and opening an exhaust blowdown valve to relieve pressure in a sump. The pressure settings of the compressor are fixed until an operator manually changes them. When this compressor unloads, a timer is started that counts down towards a command to turn off the motor. This timer duration is set by the operator and is rarely adjusted from factory conservative settings. There is a more sophisticated control method that allows the operator to select the number of motor starts per hour the compressor can use. At the start of every hour the counter resets to zero starts used. If the operator sets the compressor to 6 starts per hour, the first time the compressor reaches the upper pressure setpoint the compressor will unload and turn off the motor. When pressure reaches the start value, the compressor will start the motor and load the compressor. The next time the compressor reaches the upper pressure setpoint it unloads. The controller divides the remaining time in the hour by the number of remaining motor starts allowed to define the minimum cycle time. This time is used to determine how long the compressor needs to run unloaded before stopping the motor. It does not evaluate demand in real time and will not adjust off time based on a cycle duration prediction. With larger motors they do not evaluate operation to predict heat load and evaluate that against motor design to calculate off duration, it is a simple fixed number of starts per hour that requires an operator to adjust it, which rarely occurs. It is common to find variable speed drive controls for rotary screw compressors and there is one currently known manufacturer that uses it on a smaller 10 hp reciprocating air compressor. The electronic controller is sophisticated in how it controls the speed of the motor but this logic is limited to only controlling motor speed. From an air compressor perspective, the controller operates based on a target pressure with an upper pressure limit and a motor speed range. The user sets a target pressure and the controller will speed up or slow down the motor in an attempt to maintain pressure close to the target value. When the motor is reduced to minimum speed, the pressure will continue to rise if demand is less than the compressor output until pressure reaches the stop pressure value and the motor will stop. Pressure will decay until reaching target pressure triggering the compressor to start the motor and control to target pressure again. All operating settings are set by the operator.

The largest segment of the air compressor market by population, or number of units sold annually, is the small reciprocating air compressor. Reciprocating air compressors are often referred to as piston-style air compressors. In the industrial market, these units range from 5-30 hp and are priced from $1 k-$10 k. There is also a lower tier commercial or hobby segment for this product which are lower-cost units designed for light-duty, ranging in size from ¼ hp-5 hp and price range from $100-$1500. All these piston style reciprocating air compressors have very low value per unit for parts and service. Consequently, there has been very little done to apply new technology since it would add cost.

There is also a specialty reciprocating air compressor market for high-pressure air and gasses. These units are in the $50 k-$900 k range and may utilize a PLC-type controller to monitor and operate these larger, more costly units. Operation is still very basic, limiting the compressor to start and stop or load and unload at user-defined pressure values. This is a very small segment of the compressor market.

The common industrial reciprocating air compressor has been controlled the same way for the past century. It is a low-cost, high-volume product that is very price sensitive. The compressor is commonly operated using a simple start/stop control logic using a mechanical spring and diaphragm pressure switch. Air pressure from the tank presses against the diaphragm surface. Working against the force of the diaphragm is a spring and lever assembly. As the force compresses the spring it will eventually trip the leverage device that opens an electronic contactor or switch, isolating power to the motor and stopping the compressor. The opposing force of the spring is adjusted by turning a screw to adjust load on the spring, influencing the pressure required to trip the switch. The electronic contact surface on the switch is typically limited to electrical loads of 5 hp or less. Above that load a secondary contactor is used to support opening and closing the circuit for primary power to the motor. This contactor is opened and closed using a magnetic coil that is energized using a small electrical signal that passes through the pressure switch. The pressure switch still operates the same way for larger horsepower units; it just does not support the total electrical load. As pressure decays in the system the force acting on the diaphragm is reduced. To provide some difference between the stop and start pressures on the pressure switch there is a secondary spring that holds the contactor open. The contactor will not open until the force acting on the primary spring and lever is sufficient to pull the contactor closed. For most pressure switches used today, this differential pressure spring is not adjustable. For some industrial compressors the pressure switch is factory set and is not adjustable at all. These units will typically cycle the compressor on at 125 psig and off at 175 psig. These pressure switches are cheap and operation is not very repeatable so the actual start and stop pressures can vary throughout the day and over the life of the switch. This simple pressure switch control is used by all manufacturers.

With regards to reduced pressure starting, the small reciprocating air compressor should not start under pressure. This can either cause the unit to overload the electrical circuit and trip an electrical safety, or for some units, the compressor will start but the high load taxes the motor and mechanical components. Repeated loaded starts will eventually cause the electric motor to fail or can cause catastrophic mechanical failure of the compressor. To minimize the potential of this from occurring, the reciprocating air compressor uses a check valve that allows air to exit the compressor pump into the tank while it is loaded but does not allow air to travel from the tank back to the compressor when the pump is unloaded or off. When the compressor turns off, a small valve is opened to exhaust air trapped between the pump and the check valve. For many reciprocating air compressors this valve is mounted on the pressure switch and the same lever that opens the electrical contacts is used to depress a small pin that opens the valve. This holds that valve in an open position until the pressure switch closes the electrical contact moving the lever and closing the valve. Some compressors use another style of mechanical switch that opens the blowdown valve when the pump stops rotating. Functionally they are the same, open the valve when the pump stops and close the valve when the pump starts. When the check valve fails it leaks air past the check valve. This air will vent to the atmosphere causing the compressor to run more frequently, increasing energy consumption and thereby reducing life of the compressor. As the leak rate across the check valve increases, back pressure increases ahead of the blowdown valve, thereby, consequently increasing pressure acting on the pump when it starts. This back pressure at every start over time causes the motor to fail or catastrophic failure to the pump due to excess fatigue from every start.

With regards to high demand control options, more costly industrial reciprocating air compressors have a secondary control option used when demand for compressed air is very high. When demand is high, the motor will turn the pump at full load for extended periods of time. This generates a large heat load in the motor and pump. When the compressor reaches the upper pressure limit the motor turns off, but because the demand for air is high, the pressure drops quickly consequently turning the motor and pump back on before they can dissipate heat. This shortens life expectancy on the motor and pump. To assist with heat dissipation some compressors are equipped with head unloaders that force the intake valves to stay open so the compressor pump cannot build pressure. This allows the pump and motor to turn without generating the heat from compression, allowing the pump and motor to cool before reloading. The head unloaders are pneumatic and require air pressure to engage the head unloaders. This is accommodated using a pneumatic device similar to a pressure switch that opens a circuit to pressurize and open the head unloaders at an upper pressure and close the circuit at a lower pressure. This is adjusted by a mechanism that changes tension on a spring within the device. The compressor cannot select one control mechanism over the other so the pressure switch that turns the motor on/off is always active. To allow this to work the upper pressure setting that activates the head unloader is less than the value that causes the pressure switch to turn off the motor. If there was no way of isolating the pneumatic circuit to the head unloaders, the motor would never turn off. To accommodate using one control method over the other, an operator needs to open an isolation valve on the compressor to activate the pneumatic circuit for the head unloaders and then must close the valve to isolate the circuit. There is no alert telling anyone when to activate this circuit, and unless there is a very obvious application that demands the higher volumes of air, it is not activated, so typically is not fully utilized to protect the mechanical integrity of the air compressor pump and motor as intended.

Compressor protection is done using threshold based alarms or switches. These are limited to over/under pressure alarms, temperature alarms and in some cases rapid cycling alarms. Recently some OEMs are claiming predictive capabilities but this is based on alerting the user of reaching run hour milestones to promote scheduled maintenance. Marketing materials are starting to use terms like AI (artificial intelligence) and machine learning but to date this has been limited to predicting when a compressor will reach a run hour service milestone. Marketing materials promote increased compressor reliability and efficiency using data but this is an assumption based on following preventative maintenance recommendations using time based milestones.

Preventative maintenance schedules for an air compressor will define parts and consumables that should be replaced based on run hour milestone periods or calendar time. Diagnostics to identify an operating issue and parts that require service requires an experienced individual. Some diagnostic capabilities leverage historic data that is reviewed by subject matter experts to predict a component failure. There is no evidence of any autonomous diagnostic capabilities at the component level supported by logic only.

Current control offerings and methods include system controls. There are PC (personal computer) and PLC (programmable logic controller) based offerings, also known as sequencers, that sequence the operation of multiple compressors. This is predominantly an offering for centrifugal and rotary screw type compressors where the energy savings can easily justify the cost of hardware, installation and integration (setup). Some of these controls have logic to alert the user of compressor running hours and when milestone preventative maintenance hours are pending. For efficiency enhancement the sequencers can operate multiple compressors within the same pressure range but this is based on user defined values. Advanced logic will look at changes in pressure with respect to time to delay starting an additional compressor to a sequence if the demand for additional capacity is a short event that could be avoided.

For the small reciprocating air compressor market the control logic is very simple due to cost and will be limited to what is referred to as lead-lag-alternate. This could also be referenced as a lead/lag alternator, as the name implies, it alternates two compressors between the lead and lag position in a sequence. This is used for systems with two reciprocating compressors and is designed to balance run hours and start a second compressor when demand for compressed air exceeds one compressor. The controller is typically mechanical consisting of two pressure switches, two magnetic starters and an alternator. Pressure switch settings are staggered so the lead switch will start a compressor first and then if pressure continues to fall it will trip the lagging pressure switch to start the second compressor. As pressure rises in the system with both compressors running, the lagging compressor switch will be the first to turn off it's associated compressor. The next time the lagging pressure switch starts the compressor the alternator switches the compressor associated with the switch so the next time the pressure rises the switch turns off the other compressor. Similarly, the lead switch will toggle the alternator every time it turns its associated compressor off.

There is only one known electronic controller on the market specifically designed for small reciprocating air compressors. It is marketed by a company called Compressor Controller, a division of SAM Controllers, of Pittsboro, NC. Although their advertisements use a collection of current digital buzz words, like artificial intelligence and edge processing, there is no evidence of this in their product or the operation. It operates like a traditional pressure switch using a digital device and a single pressure transducer mounted on the tank to turn the compressor on and off based on two manually entered pressure values. These values only change if they are manually changed by an operator by turning a screw in the back of the controller. They claim efficiency because the digital controller starts and stops more precisely within the defined pressure band than a pressure switch. The controller incorporates a signal to open and close a solenoid valve to drain condensate from the tank, but this is an established offering that has been around for decades. They market a rupture protection that will turn off the air compressor if there is a catastrophic rupture in a pipe or hose. This consists of a simple timer that will turn the compressor off if it is running beyond a threshold period of time at a pressure less than the start pressure. They also offer what is called sensitivity adjustment but this is just an increased time period before shutting the compressor off and indicating a rupture fault. It does not have a rate of change to calculate demand or incorporate any intelligence to determine on its own if the excessive load is due to an excessive demand for air or an actual rupture. The controller does not have any diagnostic capabilities and is limited to a simple threshold based high temperature alarm using a temperature probe mounted on the surface of the compressor pump. This has been a standard offering on all rotary screw and centrifugal compressors for decades.

There are an assortment of third party compressor controllers on the market for rotary screw and centrifugal compressors. Most manufacturers private label a third-party controller or have one made to their own specifications. To date there are no digital controllers offered on small industrial or commercial reciprocating air compressors from the manufacturer.

Currently there are no known controllers on the market that have any function comparable to the methods disclosed herein. This includes third party analytics tools and cloud-based platforms. Current offerings are limited to marketing collateral using terms like artificial intelligence, machine learning and data analytics. Even the limited manufacturers that have connected compressors with data aggregated on the cloud from thousands of compressors are focusing on rotary screw compressors and nothing with small reciprocating compressors, like the methods disclosed herein.

The instant disclosure recognizes that reciprocating air compressors generally utilize basic control logic that simply toggles the compressor to pump air or stop pumping air between two pressure settings using a mechanical pressure switch.

The instant disclosure also recognizes that the efficiency of a reciprocating air compressor decreases as the pressure at the discharge of the compressor increases.

The instant disclosure also recognizes that the discharge temperature of the air from an air compressor increases as the delivered pressure from the compressor increases. This increased temperature decreases the functional life of many air compressor components and subassemblies The instant disclosure also recognizes that an electric motor requires a minimum amount of off time based on a percentage of load, time running at load, and motor design. Failing to have sufficient off time will rapidly degrade the motor causing premature motor failure.

The instant disclosure also recognizes that the vast majority of reciprocating air compressors in use and sold are single-stage or two-stage compressors that are air-cooled, and less than 40 hp. The majority of these compressors are not intended to run fully loaded continuously for multiple hours due to limited cooling, wherein compressor life will degrade rapidly as the sustained number of running hours increases the temperature of the compressor pump.

The instant disclosure also recognizes that a large majority of reciprocating air compressors sold and in use have instrumentation limited to a mechanical air pressure gauge and a limited number of units may have an hour counter indicating the accumulated number of hours the motor has been on.

The instant disclosure also recognizes that a large majority of reciprocating air compressors sold and in use operate using a simple stop/start logic controlled by a mechanical pressure switch. This same style of switch has been in use for decades. Some of these compressors may incorporate a secondary control method that utilizes a pneumatic type of pressure switch to load and unload the compressor by applying air to an unloader mechanism that prevents the compressor from pumping air without turning off the motor. This pneumatic control operates at a pressure range within the upper and lower set points of the stop/start switch and requires an operator to open a pneumatic valve to activate this secondary control. The secondary control stays active with the motor running continuously until an operator closes the pneumatic valve to isolate the secondary control circuit.

The instant disclosure also recognizes that the difference between the start and stop pressure is directly proportional to the time the compressor is on while the system is pressurizing and off while pressure decays to the start value. It is common to set the pressure switch stop value to the maximum pressure rating of the compressor and the lower value above an assumed market requirement to maximize the on/off duration. For cost savings, many of the lower-cost compressors have a pressure switch that is not adjustable.

In sum, the instant disclosure recognizes that current controls and/or control logic for reciprocating air compressors lacks the ability to alter operating parameters to improve efficiency, reliability, or to diagnose components of the air compressor that are not operating correctly and require service.

The instant disclosure may be designed to address at least certain aspects of the problems or needs discussed above by providing an intelligent controller for a reciprocating air compressor, and methods of use thereof.

SUMMARY

The present disclosure may solve the aforementioned limitations of the currently available air compressors and controls therefor, like reciprocating air compressors and controls for such reciprocating air compressors, by providing an intelligent controller for a reciprocating air compressor, and methods of use thereof. The intelligent controller for the reciprocating air compressor may generally include a processor, a plurality of sensors, and a plurality of peripheral devices. The plurality of sensors may be in communication with the processor. The plurality of sensors may be configured to read operating data of the reciprocating air compressor and send that operating data to the processor. The plurality of peripheral devices may be in communication with the processor. Each of the plurality of peripheral devices may be configured to be controlled by the processor. The plurality of peripheral devices may be configured to operatively control the reciprocating air compressor. Wherein, the processor may be configured to read data from the plurality of sensors and control the plurality of peripheral devices to intelligently extend life of the reciprocating air compressor and reduce energy consumption of the reciprocating air compressor.

One feature of the disclosed intelligent controller may be that it can be configured to calculate an optimum start and stop pressure value to maximize compressor efficiency, and minimize heat buildup without stressing the motor or the air compressor pump based on an entered minimum required pressure.

Another feature of the disclosed intelligent controller may be that it can detect a failure of the check valve and communicate the failure of the check valve and alter operation to protect the reciprocating air compressor from damage.

Another feature of the disclosed intelligent controller may be that it can detect a failure of an exhaust valve and communicate the failure of the exhaust valve.

Another feature of the disclosed intelligent controller may be that it can utilize the operating data of the reciprocating air compressor to diagnose subassembly or component degradation or failure and communicate the component failure to a user, and if required, limiting air compressor operation to prevent a catastrophic failure.

Another feature of the disclosed intelligent controller may be that it can control the reciprocating air compressor to extend the life of the reciprocating air compressor by identifying hazardous operating conditions and warning the user, and if required, limiting compressor function to protect the reciprocating air compressor from the catastrophic failure.

Another feature of the disclosed intelligent controller may be that it can improve efficiency and reliability of the reciprocating air compressor by adjusting control methods via the processor based on contextual decisions to deliver a desired pressure without over pressurizing the reciprocating air compressor or cycling the motor and the air compressor pump excessively.

In select embodiments of the disclosed intelligent controller, the processor may be configured to use a number of networking protocols to obtain a network connection. This network connection may be made via wired or wireless communication. The network connection may be used to communicate the operating data of the reciprocating air compressor from any of the plurality of sensors. In select embodiments, the processor may be configured to make decisions to control the reciprocating air compressor with or without the network connection.

Another feature of the disclosed intelligent controller may be that the operating data from the plurality of sensors can be displayed by the processor to the user through a graphical interface.

In select embodiments of the disclosed intelligent controller, the processor can be configured to communicate with the plurality of sensors and the plurality of peripheral devices via wired communication lines or wireless communication lines.

In select embodiments of the disclosed intelligent controller, the plurality of sensors may include: at least one interstage pressure sensor, each of the at least one interstage pressure sensor is configured to monitor pressure between stages of compression; a first tank pressure sensor configured to monitor pressure of air in a tank; a final discharge pressure sensor configured to monitor pressure after an exhaust valve of a final stage, but before the check valve; the like; and/or combinations thereof. In select optional embodiments, the plurality of sensors may further include: an oil pressure sensor configured to monitor oil pressure; an air intake pressure sensor configured to monitor pressure at an inlet of a first stage; an air intake differential pressure sensor configured to monitor pressure loss across an intake filter; a valve temperature sensor, the valve temperature sensor is configured to measure the surface temperature of the exhaust valve or the intake valve; a regulated pressure sensor positioned after a tank pressure regulator, the regulated pressure sensor is configured to monitor the pressure of air exiting the tank pressure regulator; an oil level sensor being a float type device sensor to monitor the level of oil in the air compressor pump to protect from low oil levels; the like; and/or combinations thereof.

In select embodiments of the disclosed intelligent controller, the plurality of peripheral devices may include: a head unloader valve configured to energize or de-energize head unloaders for unloaded operation; a blowdown valve configured to discharge air between the exhaust valve of the final stage and the check valve going into the tank; the like; and/or combinations thereof. In select optional embodiments, the plurality of peripheral devices may further include: the tank pressure regulator configured to control pressure exiting the tank, the tank pressure regulator is configured to be manually controlled or digitally controlled; a tank drain valve configured to drain condensate from the tank; a tank discharge isolation valve being an electronically controlled valve at a discharge of the tank, the tank discharge isolation valve is configured to isolate a distribution network of piping and hose exiting the tank; a relay being an electronic on-off switch configured to control power to a starter; the like; and/or combinations thereof.

In select embodiments, the disclosed intelligent controller may include a housing. The housing may be configured to house the processor. In select embodiments, the housing may be configured to further house the plurality of sensors and/or the plurality of peripheral devices. In select embodiments, the housing may be sized similar to a conventional pressure switch size. In select embodiments, the housing may include a manifold assembly. The manifold assembly may include an internal passage configured to support multiple ports all connected to the tank. In select embodiments, the multiple ports may connect the processor to a head unloader valve, a gauge, a pressure relief valve, a discharge port, the like, and/or combinations thereof. A threaded connection point may be on a bottom or a side of the housing. The threaded connection point may be a standard pipe thread configured to mount to a pipe nipple on the tank. Wherein, the manifold assembly may be configured to supply air from the tank and to the head unloader valve through a head unloader solenoid valve. In select embodiments, the manifold assembly may include a second passage. The second passage may be connected to a compressor side of the check valve. The second passage may be configured to connect the processor with a pressure transducer and a blowdown valve.

In select embodiments, the disclosed intelligent controller may be powered by a dedicated power supply or from a compressor supply power. Wherein, a switch may incorporate a relay with main power being supplied to the motor through the intelligent controller or may have an electronic signal or a power supply to turn the motor on and off using a magnetic starter.

Another feature of the disclosed intelligent controller may be that it can be configured to detect a faulty check valve on the reciprocating air compressor.

Another feature of the disclosed intelligent controller may be that it can be configured to detect a leaking exhaust valve or a plethora of exhaust valves on the reciprocating air compressor.

Another feature of the disclosed intelligent controller may be that it can be configured to protect the reciprocating air compressor motor from failing prematurely.

Another feature of the disclosed intelligent controller may be that it can be configured to autonomously adjust start and stop pressures on the reciprocating air compressor to reduce energy and heat.

Another feature of the disclosed intelligent controller may be that it can be configured to record a new capacity baseline for a new compressor when it is started for the first time at the factory after being assembled.

Another feature of the disclosed intelligent controller may be that it can be configured to record a current capacity baseline and calculate a current system capacitance for an installation during field commissioning or any time after the reciprocating air compressor is installed in a system.

Another feature of the disclosed intelligent controller may be that it can be configured to identify a catastrophic leak or an excessive demand on the reciprocating air compressor.

Another feature of the disclosed intelligent controller may be that it can be configured to detect a leaking intake valve or a plethora of intake valves between stages on a multi-stage reciprocating air compressor.

Another feature of the disclosed intelligent controller may be that it can be configured to detect a leaking exhaust valve or a plethora of exhaust valves between stages on the multi-stage reciprocating air compressor.

In another aspect, the instant disclosure embraces the disclosed intelligent controller for a reciprocating air compressor in any embodiment and/or combination of embodiments shown and/or described herein.

In another aspect, the instant disclosure embraces a method of intelligently extending life of a reciprocating air compressor and/or reducing energy consumption of the reciprocating air compressor utilizing the disclosed intelligent controller for a reciprocating air compressor in any embodiment and/or combination of embodiments shown and/or described herein. As such, in general, the disclosed method of intelligently extending life of a reciprocating air compressor and reducing energy consumption of the reciprocating air compressor may include the steps of: providing the disclosed intelligent controller for a reciprocating air compressor in any embodiment and/or combination of embodiments shown and/or described herein; installing the intelligent controller on the reciprocating air compressor; reading data from the plurality of sensors; and controlling the plurality of peripheral devices to intelligently extend life of the reciprocating air compressor and reduce energy consumption of the reciprocating air compressor.

In select embodiments of the disclosed method of intelligently extending life of a reciprocating air compressor and/or reducing energy consumption of the reciprocating air compressor, the step of controlling the plurality of peripheral devices to intelligently extend life of the reciprocating air compressor and reduce energy consumption of the reciprocating air compressor may include the steps of: calculating an optimum start and stop pressure value to maximize compressor efficiency, and minimize heat buildup without stressing the motor or the air compressor pump based on an entered minimum required pressure; detecting a failure of the check valve and communicating the failure of the check valve and alter operation to protect the reciprocating air compressor from damage; detecting a failure of an exhaust valve and communicating the failure of the exhaust valve; utilizing the operating data of the reciprocating air compressor to diagnose subassembly or component degradation or failure and communicating the component failure to a user, and if required, limiting air compressor operation to prevent a catastrophic failure; controlling the reciprocating air compressor to extend the life of the reciprocating air compressor by identifying hazardous operating conditions and warning the user, and if required, limiting compressor function to protect the reciprocating air compressor from the catastrophic failure; improving efficiency and reliability of the reciprocating air compressor by adjusting control methods via the processor based on contextual decisions to deliver a desired pressure without over pressurizing the reciprocating air compressor or cycling the motor and the air compressor pump excessively; the like; and/or combinations thereof.

In select embodiments of the disclosed method of intelligently extending life of a reciprocating air compressor and/or reducing energy consumption of the reciprocating air compressor, the step of controlling the plurality of peripheral devices to intelligently extend life of the reciprocating air compressor and reduce energy consumption of the reciprocating air compressor may include the steps of: detecting a faulty check valve on the reciprocating air compressor; detecting a leaking exhaust valve or a plethora of exhaust valves on the reciprocating air compressor; protecting the reciprocating air compressor motor from failing prematurely; autonomously adjust start and stop pressures on the reciprocating air compressor to reduce energy and heat;

record a new capacity baseline for a new compressor when it is started for the first time at the factory after being assembled; record a current capacity baseline and calculate a current system capacitance for an installation during field commissioning or any time after the reciprocating air compressor is installed in a system; identify a catastrophic leak or an excessive demand on the reciprocating air compressor; detecting a leaking intake valve or a plethora of intake valves between stages on a multi-stage reciprocating air compressor; detecting a leaking exhaust valve or a plethora of exhaust valves between stages on the multi-stage reciprocating air compressor; testing the head unloader valve and head unloaders; testing the blowdown valve; the like; and/or combinations thereof.

In select embodiments of the disclosed method of intelligently extending life of a reciprocating air compressor and/or reducing energy consumption of the reciprocating air compressor, the step of detecting the faulty check valve on the reciprocating air compressor may include the steps of: stopping or unloading the reciprocating air compressor; opening an electronically controlled valve to exhaust air from the discharge of the air compressor ahead of a check valve; analyzing data from a pressure sensor installed on the line between the air compressor discharge and the check valve, calculate and save time required to reduce pressure in the line to a safe start pressure for the air compressor wherein this data may be used to determine when to initiate the compressor start sequence; closing the electronically controlled valve after a predetermined or calculated period of time; analyzing data from a pressure sensor installed on the line between the air compressor discharge and the check valve to identify air leaking past the check valve; communicating a check valve failure if the analysis determines the check valve is leaking; keeping the electronically controlled valve closed to prevent the compressed air leaking past the check valve from exhausting to the atmosphere saving energy by not wasting stored compressed air; and analyzing data from a pressure sensor installed on the tank circuit to calculate when to initiate a compressor start sequence so the compressor can safely start before pressure decays to a value less than a defined minimum pressure setting. The compressor start sequence may include, but is not limited to, open blowdown valve to exhaust any air that may have leaked past the check valve; signal motor to start after compressor pump discharge pressure is below a defined value; the like, etc. If pressure between the pump and the check valve does not drop below a critical pressure value the motor will not be signaled to start until pressure falls to the required value. This may be done to protect the pump and motor. For a compressor with head unloaders: if the motor was stopped the start sequence is same as above but adds energize head unloaders to reduce start load. After motor start command, head unloaders are de-energized and the blow down valve closed after predetermined time; and if motor was not stopped and the head unloaders were energized with motor running, start sequence opens blowdown valve. After a predetermined time even if pump discharge pressure is above critical pressure the head unloaders are de-energized because momentum of the flywheel will allow the pump to load against full pressure without causing damage, then close the blowdown valve.

In select embodiments of the disclosed method of intelligently extending life of a reciprocating air compressor and/or reducing energy consumption of the reciprocating air compressor, the step of detecting the leaking exhaust valve or the plethora of exhaust valves on the reciprocating air compressor may include the steps of: stopping or unloading the reciprocating air compressor; keeping the blowdown valve (used to evacuate air between the check valve and pump discharge) in a closed state to not evacuate air from a discharge line of the air compressor; analyzing data from a pressure sensor installed on the line between the air compressor discharge and the check valve to identify a leaking exhaust valve; communicating an air compressor exhaust valve failure if the analysis determines one or more exhaust valves are leaking; if pressure decays to a value close to zero or less than the tank pressure this indicates the check valve is holding but the air has leaked past the exhaust valves and out through the crank case vent or intake valves if they are also leaking; evaluating exhaust valve leakage including trending compressor capacity by rate of pressure change with respect to time and also by monitoring discharge temperature, thereby increasing confidence in the failure diagnosis or evaluating severity; and if pressure tracks with the tank pressure, communicating the exhaust valves are holding and working fine.

In select embodiments of the disclosed method of intelligently extending life of a reciprocating air compressor and/or reducing energy consumption of the reciprocating air compressor, the step of protecting the reciprocating air compressor motor from failing prematurely may include the steps of: analyzing data from a pressure sensor while the reciprocating air compressor is loaded to estimate the time the motor will be off after reaching the stop pressure target; analyzing the reciprocating air compressor motor design data, loaded time, possibly pressure, possibly temperature, and possibly motor age to estimate a minimum safe motor off duration; deciding to unload the reciprocating air compressor or stop the motor by comparing the estimated time the motor will be off after reaching the stop pressure target with the calculated minimum safe motor off duration; and deciding to temporarily raise the motor stop pressure setting to extend the calculated off time to protect the motor if the air compressor is not capable of unloading the compressor pump while keeping the motor on.

In select embodiments of the disclosed method of intelligently extending life of a reciprocating air compressor and/or reducing energy consumption of the reciprocating air compressor, the step of autonomously adjusting the start and stop pressures on the reciprocating air compressor to reduce energy and heat may include the steps of: analyzing data from a single or plethora of pressure sensors while the compressor is loaded and off to estimate loaded and off duration as a function of the loaded rate of change; analyzing the change in pressure with respect to time while the reciprocating air compressor is loaded, calculate the stop-unload pressure required to satisfy the minimum threshold loaded time and off time to reliably cycle the reciprocating air compressor; and stopping or unloading the reciprocating air compressor using the calculated pressure value.

In select embodiments of the disclosed method of intelligently extending life of a reciprocating air compressor and/or reducing energy consumption of the reciprocating air compressor, the step of recording the new capacity baseline for the new compressor when it is started for the first time at the factory after being assembled may include the steps of: upon the first startup of the new compressor at the factory, measuring and recording pressure rate of change as part of the initial controller registration and commissioning, wherein this value of pressure rate of change is used for quality verification by the supplier and future performance verification; and as part of the controller commissioning during the initial factory registration, the compressor model information associating the compressor factory capacity rating, tank volume and other factory settings allocated to the model for future control and calculator purposes.

In select embodiments of the disclosed method of intelligently extending life of a reciprocating air compressor and/or reducing energy consumption of the reciprocating air compressor, the step of recording the current capacity baseline and calculate the current system capacitance for the installation during field commissioning or any time after the reciprocating air compressor is installed in the system may include the steps of: in the field, isolating the tank and conducting a performance verification test to compare and quantify compressor performance against the factory new baseline value; and upon field installation startup, measuring and recording running pressure rate of change and off pressure rate of change, wherein the intelligent controller using this information and the factory commissioning data to calculate capacitance of the installation system, wherein this data is used to calculate volume flow rate, leak rate and as a baseline to detect degradation in compressor performance.

In select embodiments of the disclosed method of intelligently extending life of a reciprocating air compressor and/or reducing energy consumption of the reciprocating air compressor, the step of identifying a catastrophic leak or an excessive demand on the reciprocating air compressor may include the steps of: while the reciprocating air compressor is running fully loaded and encounters a negative pressure rate of change, reducing pressure to a defined value below the start pressure and for a calculated period of time the compressor is stopped; if pressure stops dropping or the negative rate of change is less than or equal to the normal leak value or continues to decay to a value close to zero, automatically restarting the reciprocating air compressor; if pressure builds in the system to some defined value above the start pressure, documenting the excessive demand event with start time, duration, and estimated volume flow rate and communicating as an exceeded capacity event warning; if pressure will not recover when the compressor is turned back on, turning off the reciprocating air compressor and communicating a catastrophic leak message, wherein it is determined to be a catastrophic leak because the excessive demand event did not stop after pressure decreased to an unproductive level implying the event was not monitored or intentional; and communicating events along with an estimated volume, time of day and duration thereby helping the compressor owner determine if they can modify their compressed air usage or consider upgrading their compressed air system. This customer message may be related to the excessive demand diagnosis. For the catastrophic leak diagnosis the time and volume estimate may help the customer identify the leak source so they can repair it. Stopping the compressor protects it from potentially running fully loaded at an excessively low pressure and extended time that would cause catastrophic failure of the compressor pump.

In select embodiments of the disclosed method of intelligently extending life of a reciprocating air compressor and/or reducing energy consumption of the reciprocating air compressor, the step of detecting a leaking intake valve or a plethora of intake valves between stages on a multi-stage reciprocating air compressor may include the steps of: analyzing data from a plethora of pressure sensors installed between stages of the multi-stage reciprocating air compressor, wherein a faulty or failing intake valve will cause interstage pressure to increase above an operating baseline value or pressure will increase after the reciprocating air compressor stops or operates in an unloaded state; communicating an air compressor intake valve failure if the analysis determines one or more intake valves are leaking; and communicating the specific stage of the multi-stage reciprocating air compressor intake valve failure if the analysis determines one or more intake valves are leaking.

In select embodiments of the disclosed method of intelligently extending life of a reciprocating air compressor and/or reducing energy consumption of the reciprocating air compressor, the step of detecting a leaking exhaust valve or a plethora of exhaust valves between stages on the multi-stage reciprocating air compressor may include the steps of: analyzing data from a plethora of pressure sensors installed between stages of the multi-stage reciprocating air compressor, wherein a faulty or failing exhaust valve will cause interstage pressure to decrease below an operating baseline value or pressure will decrease after the compressor stops or operates in an unloaded state; communicating an air compressor exhaust valve failure if the analysis determines one or more exhaust valves are leaking; and communicating the specific stage of the multi-stage reciprocating air compressor exhaust valve failure if the analysis determines one or more exhaust valves are leaking.

In select embodiments of the disclosed method of intelligently extending life of a reciprocating air compressor and/or reducing energy consumption of the reciprocating air compressor, the step of testing the head unloader valve and head unloaders may include the steps of: when the controller logic sends a command to energize the head unloader valve, the valve opens and air at pressure is applied to the head unloaders, wherein one of the head unloaders is mounted on each first stage intake valve, and the compressor pump has one or a plethora of intake valves; after the unload command has been sent, pressurizing the head unloaders will hold the first stage intake valves open and the compressor will not be able to compress air and the mass flow of air from the compressor will become zero, wherein: if all of the head unloaders do not function, the compressor output may only be partially reduced, whereby the controller can analyze the change in tank pressure over time and if activating the head unloader circuit does not reduce the calculated output of the compressor, a head unloader fault will be identified and communicated; if the change in capacity output is only reduced but indicates the compressor is still pumping a percentage of air, the compressor motor is turned off using the motor stop control sequence; if the change in pressure is zero or drops over time this indicates a head unloader failure; if energizing the head unloaders does not change the rate of pressure increase over time in the tank, the issue is a head unloader valve failure, wherein if this occurs the compressor will operate using the motor stop/start control method until the head unloader fault has been corrected; and wherein the testing of the head unloader valve and the head unloaders is configured to be manually initiated or executed at some calculated interval or when it is a utilized control mode.

In select embodiments of the disclosed method of intelligently extending life of a reciprocating air compressor and/or reducing energy consumption of the reciprocating air compressor, the step of testing the blowdown valve may include the steps of: manually initiating or autonomously executing the testing of the blowdown valve every time the blowdown valve is commanded to open or close; wherein: if the compressor is running and the motor is turned off where the blowdown valve is signaled/commanded to open and pressure in the line between the check valve and the pump does not drop at all this is an indication that the blowdown valve will not open and a blowdown valve closed valve fault shall be communicated; if the compressor pressure in this line cannot be exhausted the compressor is started using the head unloaders; if the head unloaders are not available the compressor is configured to not initiate a motor start command until the pressure drops to a predetermined acceptable value which is configured to include pressure dropping to that value in the tank; when the compressor is off and the compressor is commanded to start and load, the command is given to close the blowdown valve, wherein: if the pressure ahead of the check valve does not increase to a value greater than or equal to the tank pressure in a predetermined or calculated amount of time, this indicates the blowdown valve is open and all air from the compressor pump is exhausted through the blowdown valve, and a blowdown valve open failure is communicated and the compressor turned off since it cannot charge the tank and will run for no purpose; if the pressure increases ahead of the check valve to a value greater than or equal to the tank pressure but pressure rate of change indicates the compressor is operating under capacity, the next time compressor turns off, the blowdown valve open command will be postponed and a decreasing or no pressure in the line ahead of the check valve will indicate a blowdown valve open valve fault.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-17, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Figure 1:
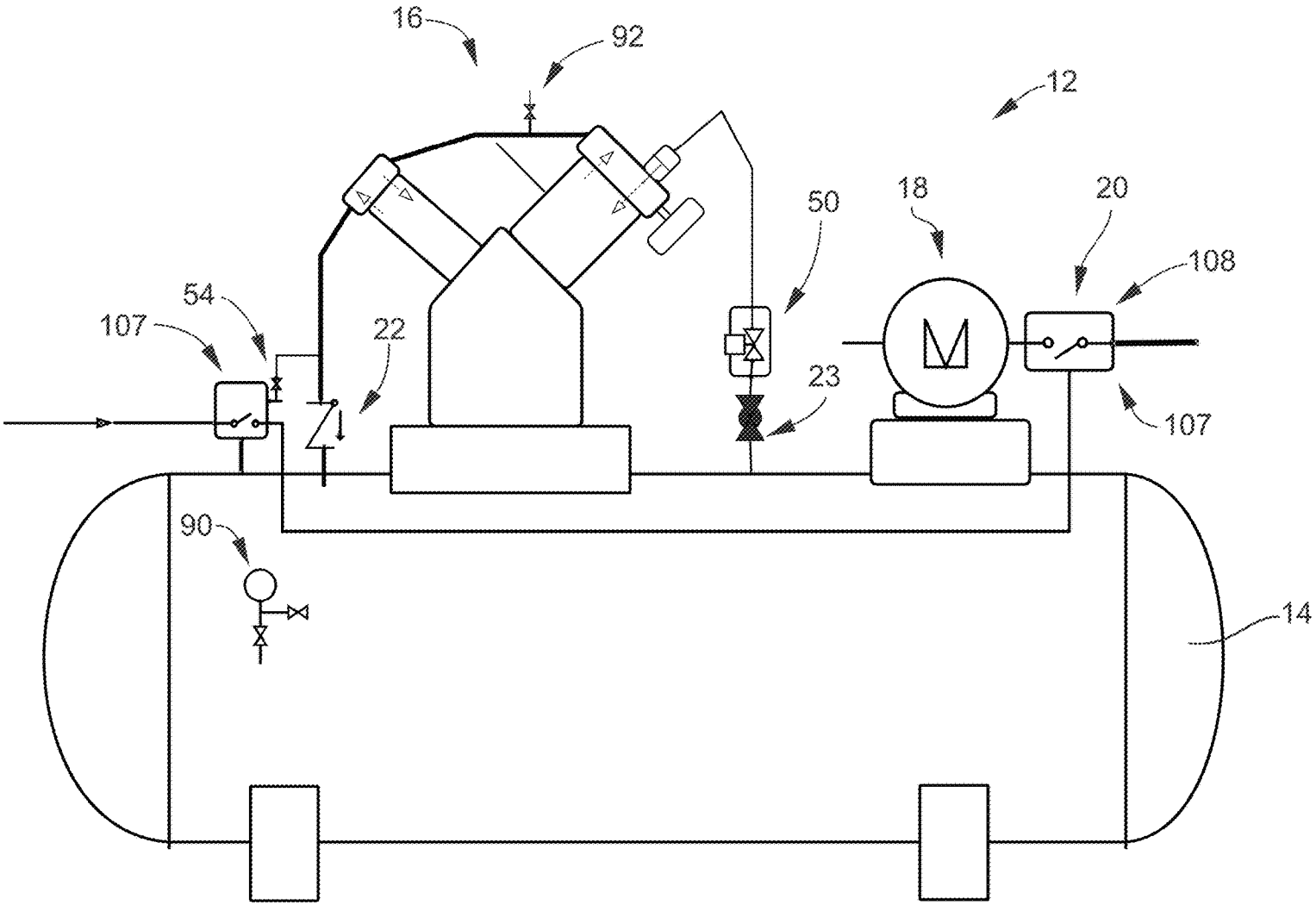
FIG. 1 (Prior Art)
FIG. 1 is a schematic front view of a reciprocating air compressor according to the prior art.

Referring first to FIG. 1, a typically known reciprocating air compressor 12 of the prior art is shown. As shown, this prior art reciprocating air compressor 12 includes tank 14, air compressor pump 16, motor 18, motor starter 20, check valve 22, ball valve 23, head unloader valve 50, blowdown valve 54, gauge 90, pressure relief valve 92, switch 107 and relay 108. The motor starter 20 is configured to control power of the reciprocating air compressor 12. Mechanical pressure switch 107 and blowdown valve 54 are used. Wherein, the tank pressure in tank 14 acts against a diaphragm and spring to open/close the electrical circuit of the switch 107 and blowdown valve 54. Pressure relief valve 92 is a pressure activated safety relief valve. Head unloader valve 50 is also pressure activated. Motor starter 20 is a motor main power circuit/magnetic starter. Currently, the known current controls and/or control logic for reciprocating air compressor 12 lacks the ability to alter operating parameters to improve efficiency, reliability, or to diagnose components of reciprocating air compressor 12 that are not operating correctly and require service.

Referring to FIGS. 2-17, the present disclosure may solve the aforementioned limitations of the currently available reciprocating air compressors and controls thereof by providing the disclosed intelligent controller 10 for reciprocating air compressor 12 and methods 200 of use thereof.

Figure 2:
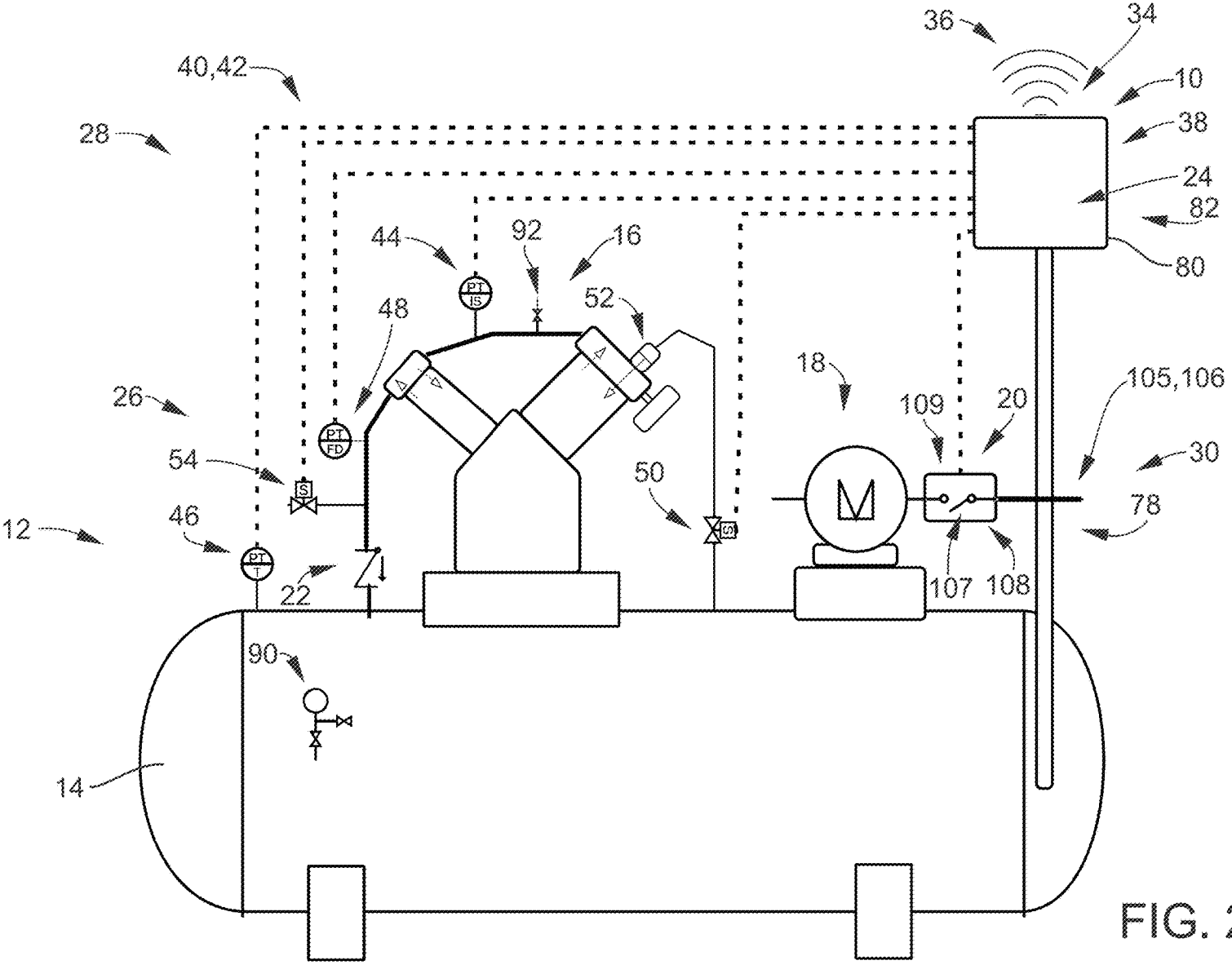
FIG. 2 is a schematic front view of a reciprocating air compressor with the intelligent controller according to select embodiments of the instant disclosure.
Figure 3:
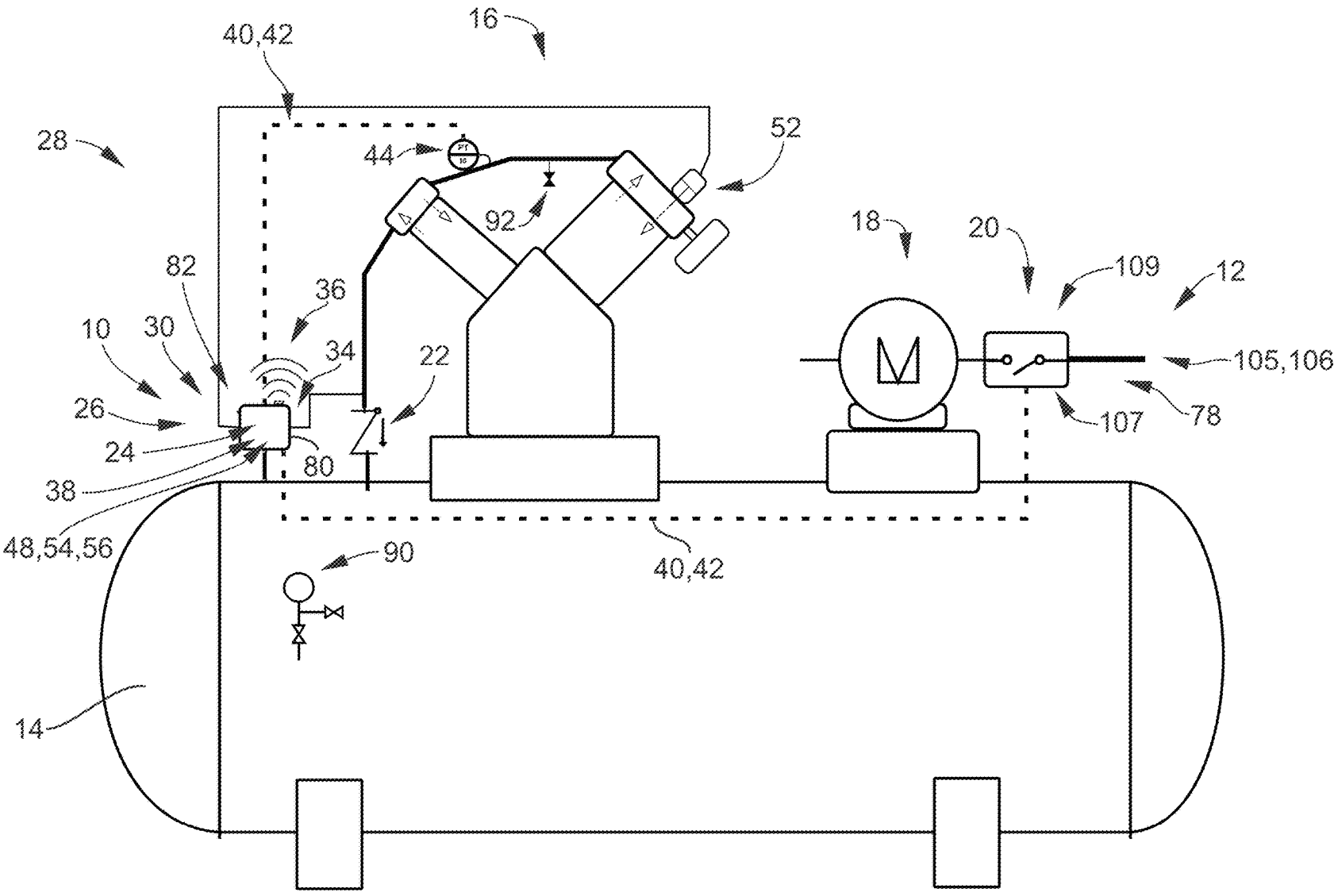
FIG. 3 is a schematic front view of a reciprocating air compressor with the intelligent controller according to select embodiments of the instant disclosure.
Figure 4B:
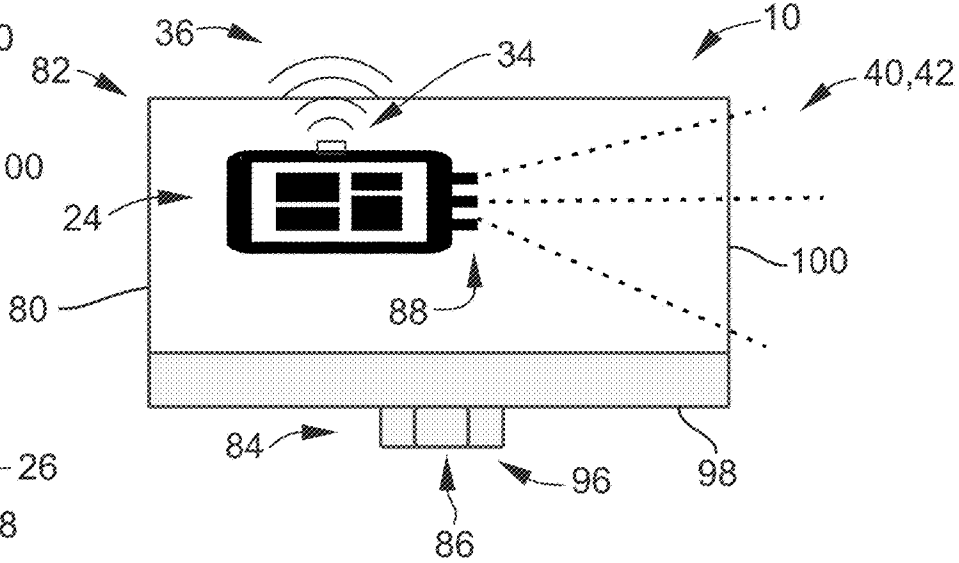
FIG. 4B is a side view of the intelligent controller from FIG. 4A.
Figure 4A:
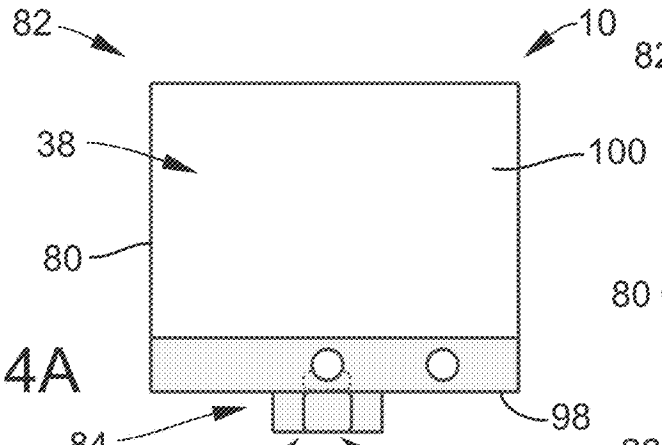
FIG. 4A is a front view of the intelligent controller for a reciprocating air compressor according to select embodiments of the instant disclosure.
Figure 4C:
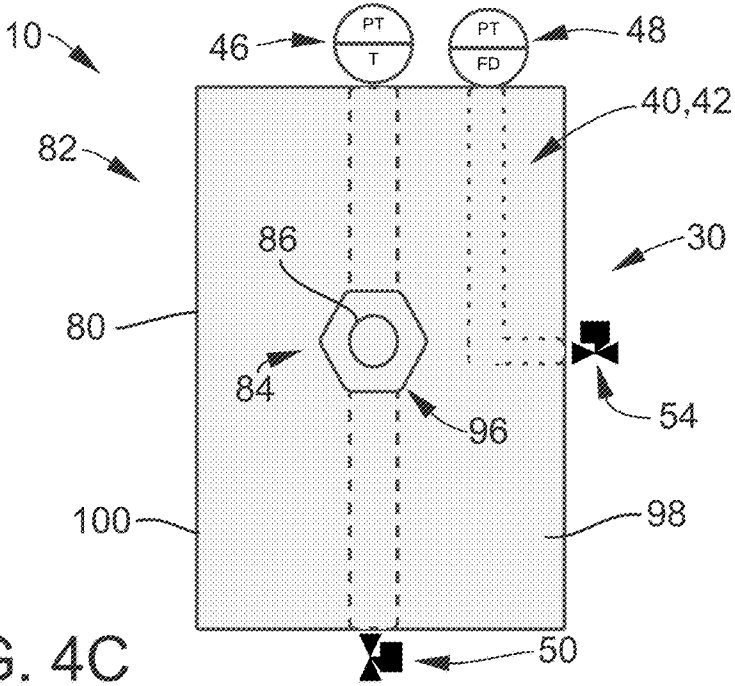
FIG. 4C is a bottom view of the intelligent controller from FIG. 4A.

Referring now specifically to FIGS. 2-4, intelligent controller 10 for reciprocating air compressor 12 may generally include processor 24, plurality of sensors 26, and plurality of peripheral devices 30. The plurality of sensors 26 may be in communication with processor 24. The plurality of sensors 26 may be configured to read operating data 28 of reciprocating air compressor 12 and send that operating data 28 to processor 24. The plurality of peripheral devices 30 may be in communication with processor 24. Each of the plurality of peripheral devices 30 may be configured to be controlled by processor 24. The plurality of peripheral devices 30 may be configured to operatively control reciprocating air compressor 12. Wherein, processor 24 may be configured to read data from the plurality of sensors 26 and control the plurality of peripheral devices 30 to intelligently extend life of reciprocating air compressor 12 and reduce energy consumption of reciprocating air compressor 12.

One feature of intelligent controller 10 may be that it can be configured to calculate an optimum start and stop pressure value to maximize compressor efficiency and minimize heat buildup without stressing motor 18 or air compressor pump 16 based on an entered minimum required pressure.

Another feature of intelligent controller 10 may be that it can detect a failure of check valve 22 and communicate the failure of check valve 22 and alter operation to protect reciprocating air compressor 12 from damage.

Another feature of intelligent controller 10 may be that it can detect a failure of an exhaust valve (not shown in the Figures) and communicate the failure of the exhaust valve.

Another feature of intelligent controller 10 may be that it can utilize operating data 28 of reciprocating air compressor 12 from sensors 26 to diagnose subassembly or component degradation or failure and communicate the component failure to a user, and if required, limiting air compressor operation to prevent a catastrophic failure.

Another feature of intelligent controller 10 may be that it can control reciprocating air compressor 12 to extend the life of the reciprocating air compressor by identifying hazardous operating conditions and warning the user, and if required, limiting compressor function to protect reciprocating air compressor 12 from the catastrophic failure.

Another feature of intelligent controller 10 may be that it can improve efficiency and reliability of reciprocating air compressor 12 by adjusting control methods via processor 24 based on contextual decisions to deliver a desired pressure without over pressurizing reciprocating air compressor 12 or cycling motor 18 and air compressor pump 16 excessively.

Processor 24 may be included with intelligent controller 10. See FIGS. 2-4. Processor 24 may be used for reading data from plurality of sensors 26 and controlling reciprocating air compressor 12 through peripheral devices 30 based off of the data read from sensors 26. Processor 24 may include any computers, circuit boards, processors, the like, etc. configured for reading data from plurality of sensors 26 and controlling reciprocating air compressor 12 through peripheral devices 30 based off of the data read from sensors 26. As an example, processor 24 may include a control board (printed circuit board) with many components to handle inputs and outputs from the connected components, i.e., sensors 26 and peripheral devices 30. This "control board" of processor 24 may contain a processor and other components for communicating with and controlling the I/O sensors and relays. Processor 24 may be a microcontroller or other computer that makes logic decisions. It is part of a larger control board, that connects to peripheral devices to change the state of the compressor. The control board could be customized to control all of the other components for intelligent controller 10; the I/O of the control board will match the components configured for intelligent controller 10. The way that the control board transmits usage data and alerts may be unique. The possibilities here are basically endless; e.g., Oil pressure low→send alert to cloud→cloud alerts user. In select embodiments of intelligent controller 10, processor 24 may be configured to use a number of networking protocols to obtain network connection 34. See FIGS. 2-4. Network connection 34 may be made via wired or wireless communication 36. Network connection 34 may be used to communicate the operating data of reciprocating air compressor 12 from any of the plurality of sensors 26. In select embodiments, processor 24 may be configured to make decisions to control reciprocating air compressor 12 with or without network connection 34. Network connection 34 may be used to communicate with a user or operator of reciprocating air compressor 12, like for communicating any failures, starts, stops, leaks, etc. This communication may be made with or without owner's approval, where the ability is provided to communicate compressor operating and fault data to the manufacturer or to an authorized service provider to expedite ordering service and/or parts.

Another feature of intelligent controller 10 may be that operating data 28 from the plurality of sensors 26 can be displayed by processor 24 to the user or operator through graphical interface 38. Graphical interface 38 may be any gauge(s), lights, screen(s), or web or mobile application(s) used to communicate to the user or operator the operating data 28 of reciprocating air compressor 12. As such, data from processor 24 can be displayed to the users through a number of graphical interfaces, including screens, status lights, or by representing data presented via a web or mobile application.

As best shown in FIGS. 2-4, in select embodiments of intelligent controller 10, processor 24 can be configured to communicate with the plurality of sensors 26 and the plurality of peripheral devices 30 via wired communication lines 40 and/or wireless communication lines 42. As such, intelligent controller 10 can be housed on reciprocating air compressor 12, or it may be remotely located.

Sensors 26 may be included with intelligent controller 10. See FIGS. 2-4. Sensors 26 may be for reading various operating data 28 from reciprocating air compressor 12. Sensors 26 may include any type or quantity of sensors configured for reading any operating data 28 of reciprocating air compressor 12. In select embodiments of intelligent controller 10, the plurality of sensors 26 may include at least one interstage pressure sensor 44. Each of the at least one interstage pressure sensors 44 may be configured to monitor pressure between stages of compression. In other select embodiments of intelligent controller 10, the plurality of sensors 26 may include first tank pressure sensor 46. First tank pressure sensor 46 may be configured to monitor pressure of air in tank 14. In other select embodiments of intelligent controller 10, the plurality of sensors 26 may include final discharge pressure sensor 48. Final discharge pressure sensor 48 may be configured to monitor pressure after an exhaust valve of a final stage, but before check valve 22. In select possibly preferred embodiments, plurality of sensors 26 of intelligent controller 10 may include a combination of interstage pressure sensor 44, first tank pressure sensor 46, and final discharge pressure sensor 48. In select optional embodiments, the plurality of sensors 26 may further include, but is not limited to: an oil pressure sensor configured to monitor oil pressure, like in a pressure lubricated compressor; an air intake pressure sensor configured to monitor pressure at an inlet of a first stage; an air intake differential pressure sensor configured to monitor pressure loss across an intake filter; a valve temperature sensor, the valve temperature sensor is configured to measure the surface temperature of the exhaust valve or the intake valve; a regulated pressure sensor positioned after a tank pressure regulator, the regulated pressure sensor is configured to monitor the pressure of air exiting the tank pressure regulator; an oil level sensor being a float type device sensor to monitor the level of oil in the air compressor pump to protect from low oil levels; the like; and/or combinations thereof.

Peripheral devices 30 may be included with intelligent controller 10. See FIGS. 2-4. Peripheral devices 30 may be for controlling various valves, switches, the like, etc. of reciprocating air compressor 12. Peripheral devices 30 may include any type or quantity of peripheral devices configured for controlling any various valves, switches, the like, etc. of reciprocating air compressor 12. In select embodiments of intelligent controller 10, the plurality of peripheral devices 30 may include head unloader valve 50. Head unloader valve 50 may be configured to energize or de-energize head unloaders 52 for unloaded operation. Head unloader valve 50 may be digitally activated by processor 24. In select embodiments of intelligent controller 10, the plurality of peripheral devices 30 may include blowdown valve 54. Blowdown valve 54 may be configured to discharge air between the exhaust valve of the final stage and check valve 22 going into tank 14. Blowdown valve 54 may be digitally activated by processor 24. In select possibly preferred embodiments, plurality of peripheral devices 30 of intelligent controller 10 may include a combination of head unloader valve 50, blowdown valve 54. In select optional embodiments, the plurality of peripheral devices 30 may further include: the tank pressure regulator configured to control pressure exiting tank 14, the tank pressure regulator may be configured to be manually controlled or digitally controlled; a tank drain valve configured to drain condensate from tank 14; a tank discharge isolation valve being an electronically controlled valve at a discharge of the tank, the tank discharge isolation valve is configured to isolate a distribution network of piping and hose exiting the tank; relay 78 being an electronic on-off switch configured to control power to starter 20; the like; and/or combinations thereof.

Still referring to FIGS. 2-4, in select embodiments, intelligent controller 10 may include housing 80. Housing 80 may be configured to house processor 24. Housing 80 may include any components and/or members configured to house processor 24. Housing 80 may be designed and configured to protect and conceal the electronic components of intelligent controller 10. In select embodiments, housing 80 may be configured to further house any of the plurality of sensors 26 and/or any of the plurality of peripheral devices 30. As shown in FIGS. 3-4, in select embodiments, housing 80 may be sized similar to conventional pressure switch size 82 (as understood by one skilled in the art). This may provide a form factor to intelligent controller 10 with any of the plurality of sensors 26 and/or plurality of peripheral devices 30 built therein. As such, in select embodiments, only processor 24 may be housed inside of housing 80 of intelligent controller 10, like as shown in FIG. 2, or on the sides of housing 80, like as shown in FIGS. 4. And in other select embodiments, some or all of sensors 26 and/or peripheral devices 30 may be housed inside of housing 80 of intelligent controller 10, like as shown in FIGS. 3-4. As best shown in FIGS. 4, in select embodiments, housing 80 may include manifold assembly 84. Manifold assembly 84 may include internal passage 86 configured to support multiple ports 88 all connected to tank 14. In select embodiments, multiple ports 88 may connect processor 24 to head unloader valve 50, gauge 90, pressure relief valve 92, a discharge port, the like, and/or combinations thereof. Threaded connection point 96 may be on bottom 98 or side 100 of housing 80. Bottom 98 may serve as a mounting platform for housing 80 of intelligent controller 10 that also serves as a pneumatic manifold, certified/or designed for required working pressure and local codes. Threaded connection point 96 may be standard pipe thread 101 configured to mount to pipe nipple 102 on tank 14. Wherein, manifold assembly 84 may be configured to supply air to tank 14 and head unloader valve 50 through head unloader solenoid valve 50. A separate circuit of the manifold may connect the final discharge line ahead of check valve 22 to the pressure transducers/sensors and blowdown valve 54. All other pneumatic and digital signals may be contained or supported by this single enclosure of housing 80. In select embodiments, manifold assembly 84 may include second passage 103. Second passage 103 may be connected to a compressor side of check valve 22. Second passage 103 may be configured to connect processor 24 with a pressure transducer and blowdown valve 54.

In select embodiments, intelligent controller 10 may be powered by a dedicated power supply 105 or from a compressor supply power 106. Wherein, switch 107 may incorporate relay 108 with main power being supplied to motor 18 through intelligent controller 10 or may have an electronic signal or a power supply to turn the motor on and off using magnetic starter 109.

Another feature of intelligent controller 10 may be that it can be configured to detect a faulty check valve 22 on reciprocating air compressor 12.

Another feature of intelligent controller 10 may be that it can be configured to detect a leaking exhaust valve or a plethora of exhaust valves on reciprocating air compressor 12.

Another feature of intelligent controller 10 may be that it can be configured to protect reciprocating air compressor motor 18 from failing prematurely.

Another feature of intelligent controller 10 may be that it can be configured to autonomously adjust start and stop pressures on reciprocating air compressor 12 to reduce energy and heat.

Another feature of intelligent controller 10 may be that it can be configured to record a new capacity baseline for a new compressor when it is started for the first time at the factory after being assembled.

Another feature of intelligent controller 10 may be that it can be configured to record a current capacity baseline and calculate a current system capacitance for an installation during field commissioning or any time after reciprocating air compressor 12 is installed in a system.

Another feature of intelligent controller 10 may be that it can be configured to identify a catastrophic leak or an excessive demand on reciprocating air compressor 12.

Another feature of intelligent controller 10 may be that it can be configured to detect a leaking intake valve or a plethora of intake valves between stages on a multi-stage reciprocating air compressor 12.

Another feature of intelligent controller 10 may be that it can be configured to detect a leaking exhaust valve or a plethora of exhaust valves between stages on the multi-stage reciprocating air compressor 12.

Referring now specifically to FIGS. 5-17, in another aspect, the instant disclosure embraces method 200 of intelligently extending life of reciprocating air compressor 12 and/or reducing energy consumption of reciprocating air compressor 12 utilizing intelligent controller 10 in any embodiment and/or combination of embodiments shown and/or described herein. As such, in general, referring to FIG. 5, method 200 of intelligently extending life of reciprocating air compressor 12 and/or reducing energy consumption of reciprocating air compressor 12 may include the steps of: step 201 of providing intelligent controller 10 for reciprocating air compressor 12 in any embodiment and/or combination of embodiments shown and/or described herein; step 202 of installing intelligent controller 10 on reciprocating air compressor 12; step 203 of reading data from the plurality of sensors 26 via processor 24; and step 204 of controlling the plurality of peripheral devices 30 via processor 24 to intelligently extend life of reciprocating air compressor 12 and reduce energy consumption of reciprocating air compressor 12.

Figure 5:
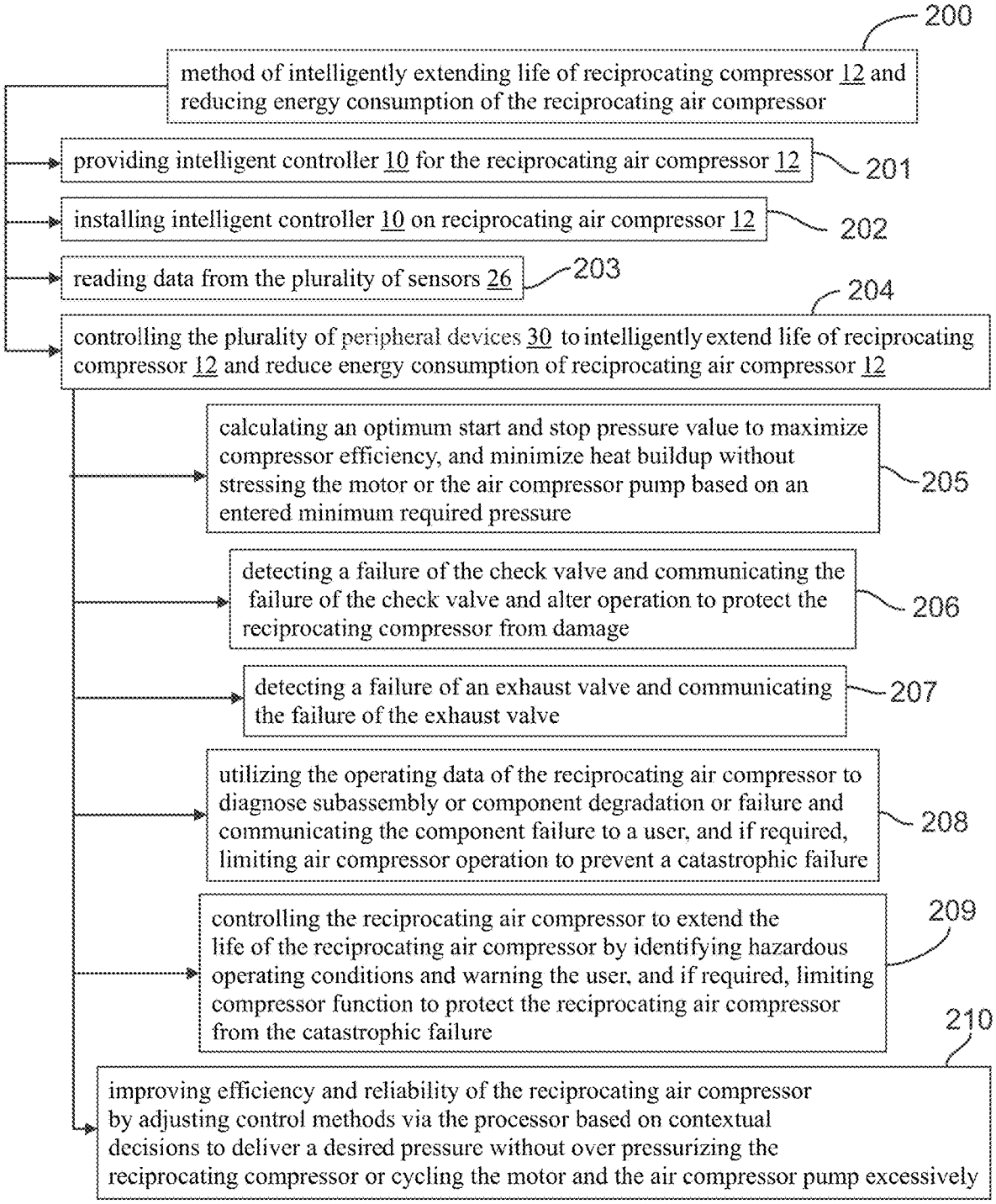
FIG. 5 is a flow chart of the method of intelligently extending life of a reciprocating air compressor and reducing energy consumption of the reciprocating air compressor according to select embodiments of the instant disclosure.

Still referring specifically to FIG. 5, in select embodiments of method 200 of intelligently extending life of reciprocating air compressor 12 and/or reducing energy consumption of reciprocating air compressor 12, step 204 of controlling the plurality of peripheral devices 30 to intelligently extend life of reciprocating air compressor 12 and reduce energy consumption of reciprocating air compressor 12 may include the steps of: step 205 of calculating an optimum start and stop pressure value to maximize compressor efficiency, and minimize heat buildup without stressing the motor or the air compressor pump based on an entered minimum required pressure; step 206 of detecting a failure of the check valve and communicating the failure of the check valve and alter operation to protect the reciprocating air compressor from damage; step 207 of detecting a failure of an exhaust valve and communicating the failure of the exhaust valve; step 208 of utilizing the operating data 28 of reciprocating air compressor 12 to diagnose subassembly or component degradation or failure and communicating the component failure to a user, and if required, limiting air compressor operation to prevent a catastrophic failure; step 209 of controlling reciprocating air compressor 12 to extend the life of reciprocating air compressor 12 by identifying hazardous operating conditions and warning the user, and if required, limiting compressor function to protect reciprocating air compressor 12 from the catastrophic failure; step 210 of improving efficiency and reliability of reciprocating air compressor 12 by adjusting control methods via processor 24 based on contextual decisions to deliver a desired pressure without over pressurizing reciprocating air compressor 12 or cycling motor 18 and air compressor pump 16 excessively; the like; and/or combinations thereof. These control methods, may include the use of stop start control or use of head unloaders.

Figure 6:
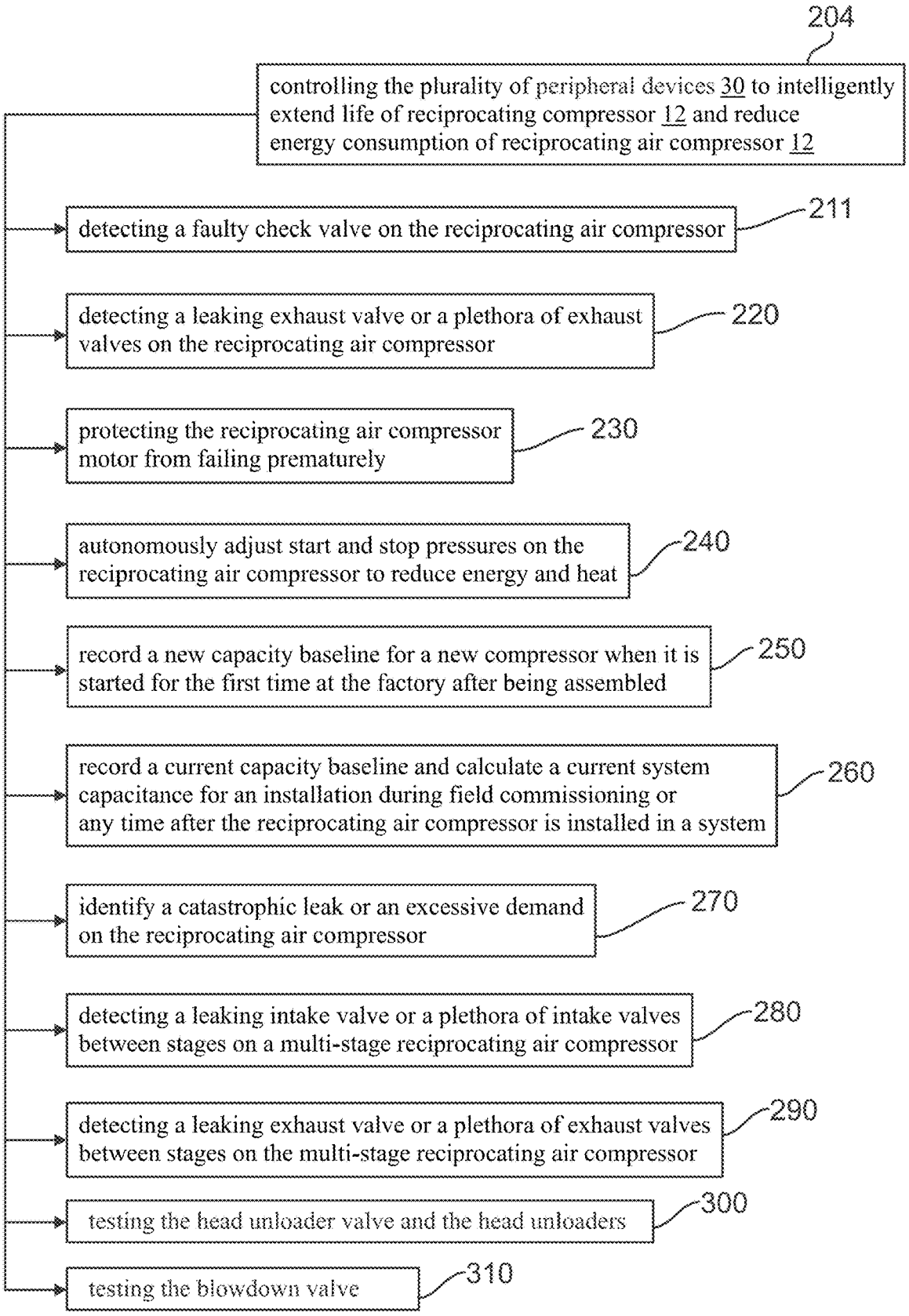
FIG. 6 is a flow chart of the step of controlling the plurality of peripheral devices to intelligently extend life of the reciprocating air compressor and reduce energy consumption of the reciprocating air compressor according to select embodiments of the instant disclosure for the disclosed method of intelligently extending life of a reciprocating air compressor and reducing energy consumption of the reciprocating air compressor.

Referring now specifically to FIG. 6, in select embodiments of method 200 of intelligently extending life of reciprocating air compressor 12 and/or reducing energy consumption of reciprocating air compressor 12, step 204 of controlling the plurality of peripheral devices 30 to intelligently extend life of reciprocating air compressor 12 and/or reduce energy consumption of reciprocating air compressor 12 may include the steps of: step 211 of detecting a faulty check valve 22 on reciprocating air compressor 12; step 220 of detecting a leaking exhaust valve or a plethora of exhaust valves on reciprocating air compressor 12; step 230 of protecting reciprocating air compressor motor 18 from failing prematurely; step 240 autonomously adjust start and stop pressures on reciprocating air compressor 12 to reduce energy and heat; step 250 of recording a new capacity baseline for a new compressor when it is started for the first time at the factory after being assembled; step 260 of recording a current capacity baseline and calculating a current system capacitance for an installation during field commissioning or any time after the reciprocating air compressor is installed in a system; step 270 of identifying a catastrophic leak or an excessive demand on reciprocating air compressor 12; step 280 of detecting a leaking intake valve or a plethora of intake valves between stages on a multi-stage reciprocating air compressor 12; step 290 of detecting a leaking exhaust valve or a plethora of exhaust valves between stages on the multi-stage reciprocating air compressor; the like; and/or combinations thereof.

Figure 7:
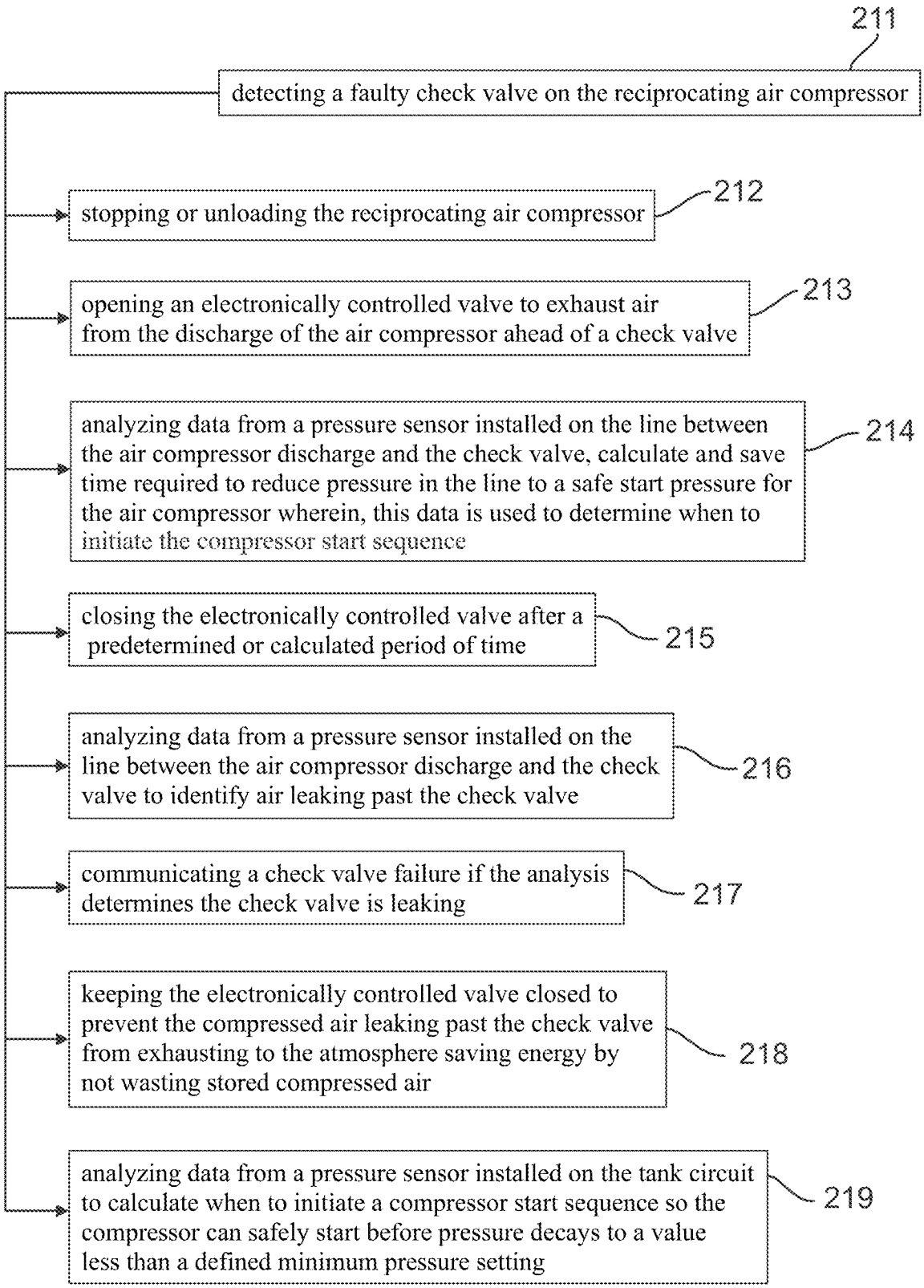
FIG. 7 is a flow chart of the step of detecting a faulty check valve on the reciprocating air compressor according to select embodiments of the instant disclosure for the disclosed method of intelligently extending life of a reciprocating air compressor and reducing energy consumption of the reciprocating air compressor.

Referring now specifically to FIG. 7, in select embodiments of method 200 of intelligently extending life of reciprocating air compressor 12 and/or reducing energy consumption of reciprocating air compressor 12, step 211 of detecting the faulty check valve 22 on reciprocating air compressor 12 may include the steps of: step 212 of stopping or unloading reciprocating air compressor 12; step 213 of opening an electronically controlled valve to exhaust air from the discharge of the air compressor ahead of check valve 22; step 214 of analyzing data from a pressure sensor installed on the line between the air compressor discharge and check valve 22, calculate and save time required to reduce pressure in the line to a safe start pressure for the air compressor, wherein this data may be used to determine when to initiate the compressor start sequence; step 215 of closing the electronically controlled valve after a predetermined or calculated period of time; step 216 of analyzing data from a pressure sensor installed on the line between the air compressor discharge and check valve 22 to identify air leaking past check valve 22; step 217 of communicating a check valve failure if the analysis determines check valve 22 is leaking, which may also include recording or saving the failure event for summary which may include statistics of frequency of check valve leak relative to unload/stop in case it is intermittent and/or trending changes in severity based on blowdown rate, all potentially to be used for severity evaluation for rate level of urgency for correcting fault (this may be a separate action applicable to all fault detections and performance evaluations or may be added to each one); step 218 of keeping the electronically controlled valve closed to prevent the compressed air leaking past check valve 22 from exhausting to the atmosphere saving energy by not wasting stored compressed air; and step 219 of analyzing data from a pressure sensor installed on the tank circuit to calculate when to initiate a compressor start sequence so the compressor can safely start before pressure decays to a value less than a defined minimum pressure setting. As examples, blowdown time may be used to calculate when to open blowdown valve 54 to achieve safe start pressure before starting the motor while ensuring compressor achieves fully loaded state before pressure drops to calculated minimum pressure value.

Figure 8:
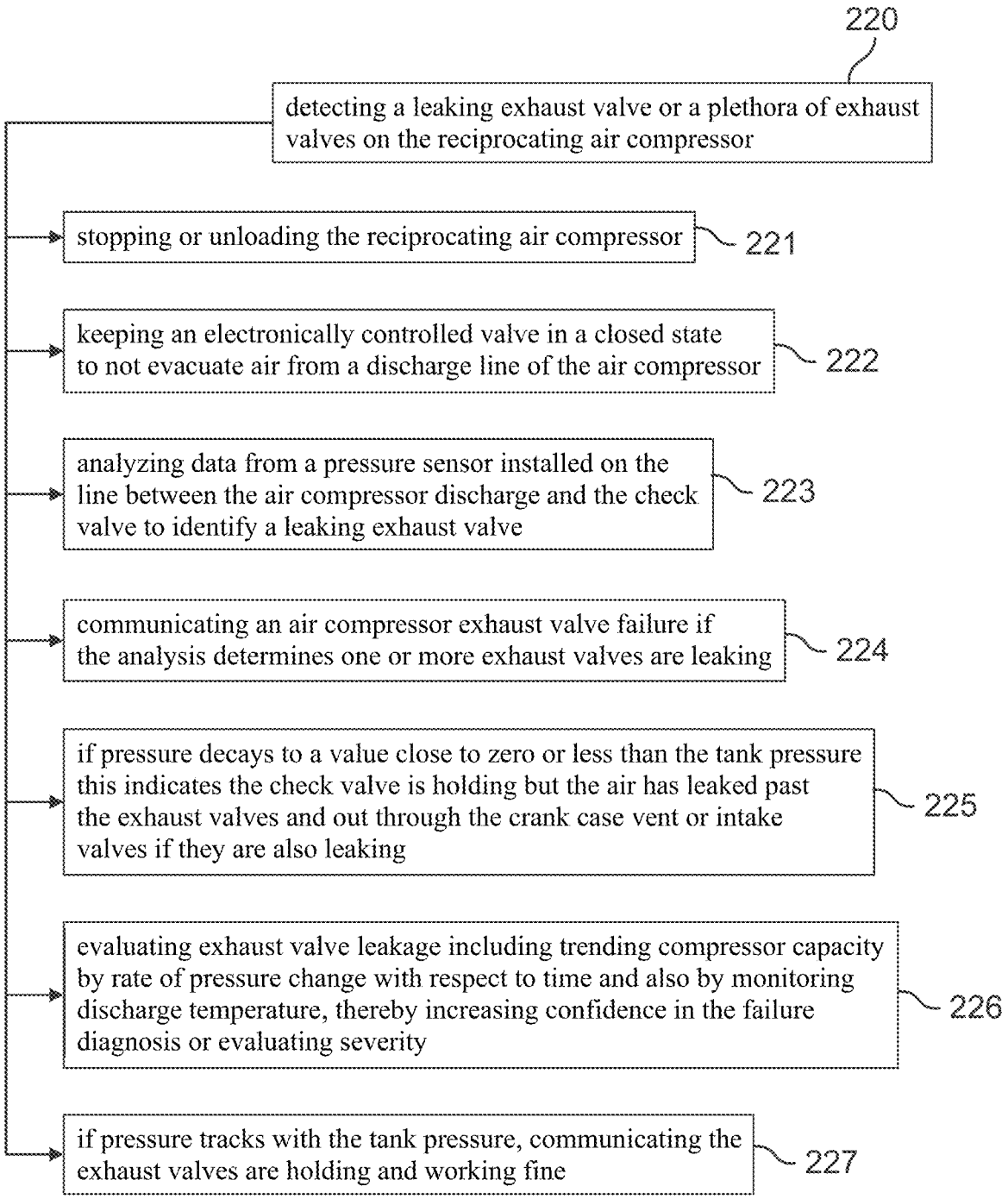
FIG. 8 is a flow chart of the step of detecting a leaking exhaust valve or a plethora of exhaust valves on the reciprocating air compressor according to select embodiments of the instant disclosure for the disclosed method of intelligently extending life of a reciprocating air compressor and reducing energy consumption of the reciprocating air compressor.

Referring now specifically to FIG. 8, in select embodiments of method 200 of intelligently extending life of reciprocating air compressor 12 and/or reducing energy consumption of reciprocating air compressor 12, step 220 of detecting the leaking exhaust valve or the plethora of exhaust valves on reciprocating air compressor 12 may include the steps of: step 221 of stopping or unloading reciprocating air compressor 12; step 222 of keeping an electronically controlled valve in a closed state to not evacuate air from a discharge line of the air compressor; step 223 of analyzing data from a pressure sensor installed on the line between the air compressor discharge and check valve 22 to identify a leaking exhaust valve; step 224 of communicating an air compressor exhaust valve failure if the analysis determines one or more exhaust valves are leaking; step 225 of if pressure decays to a value close to zero or less than the tank pressure this indicates check valve 22 is holding but the air has leaked past the exhaust valves and out through the crank case vent or intake valves if they are also leaking; step 226 of evaluating exhaust valve leakage including trending compressor capacity by rate of pressure change with respect to time and also by monitoring discharge temperature, thereby increasing confidence in the failure diagnosis or evaluating severity; and step 227 of if pressure tracks with the tank pressure, communicating the exhaust valves are holding and working fine.

Figure 9:
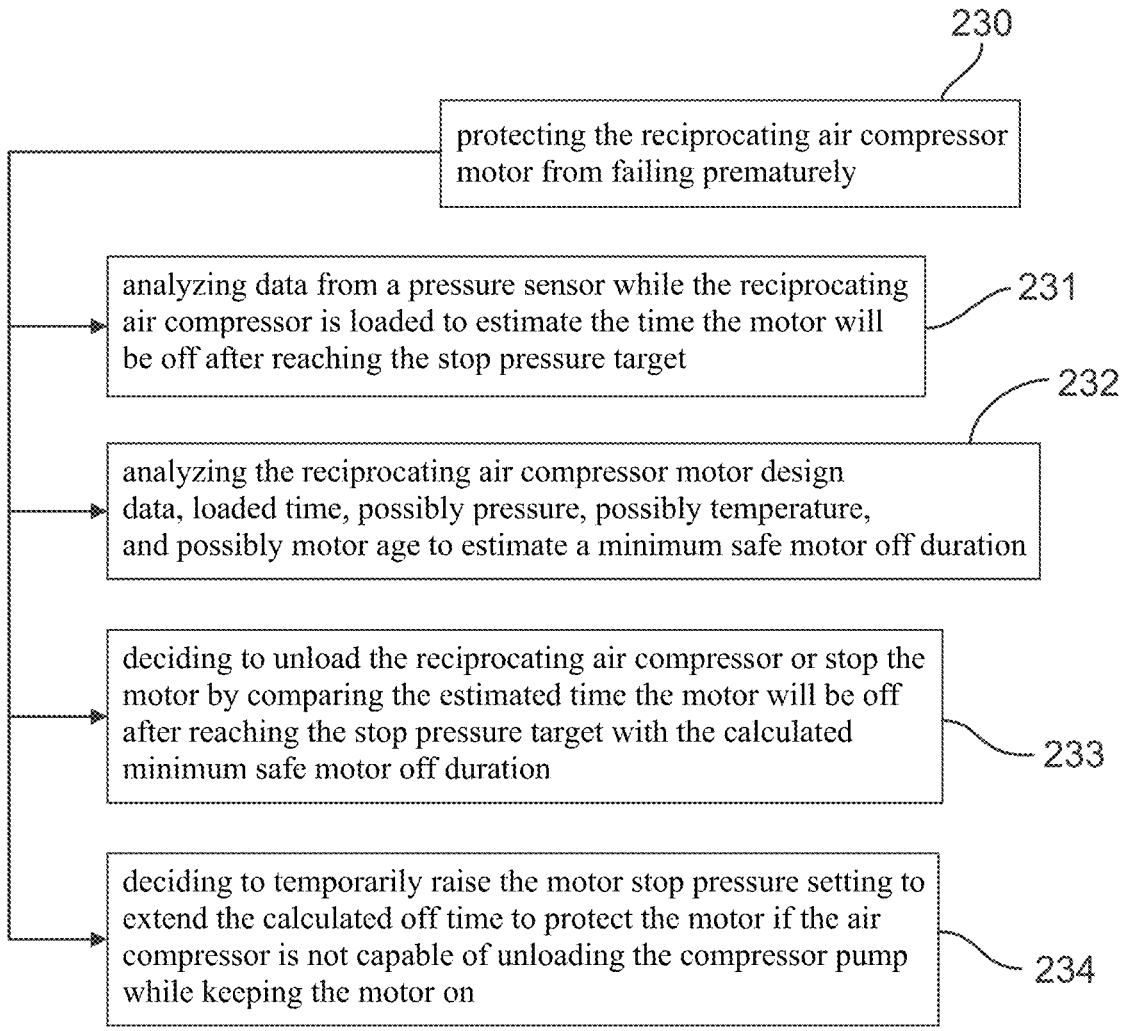
FIG. 9 is a flow chart of the step of protecting the reciprocating air compressor motor from failing prematurely according to select embodiments of the instant disclosure for the disclosed method of intelligently extending life of a reciprocating air compressor and reducing energy consumption of the reciprocating air compressor.

Referring now specifically to FIG. 9, in select embodiments of method 200 of intelligently extending life of reciprocating air compressor 12 and/or reducing energy consumption of reciprocating air compressor 12, step 230 of protecting reciprocating air compressor motor 18 from failing prematurely may include the steps of: step 231 of analyzing data from a pressure sensor while reciprocating air compressor 12 is loaded to estimate the time motor 18 will be off after reaching the stop pressure target; step 232 of analyzing the reciprocating air compressor motor design data, loaded time, possibly pressure, possibly temperature, and possibly motor age to estimate a minimum safe motor off duration; step 233 of deciding to unload reciprocating air compressor 12 or stop motor 18 by comparing the estimated time motor 18 will be off after reaching the stop pressure target with the calculated minimum safe motor off duration; and step 234 of deciding to temporarily raise the motor stop pressure setting to extend the calculated off time to protect motor 18 if the air compressor is not capable of unloading the compressor pump 16 while keeping motor 18 on.

Figure 10:
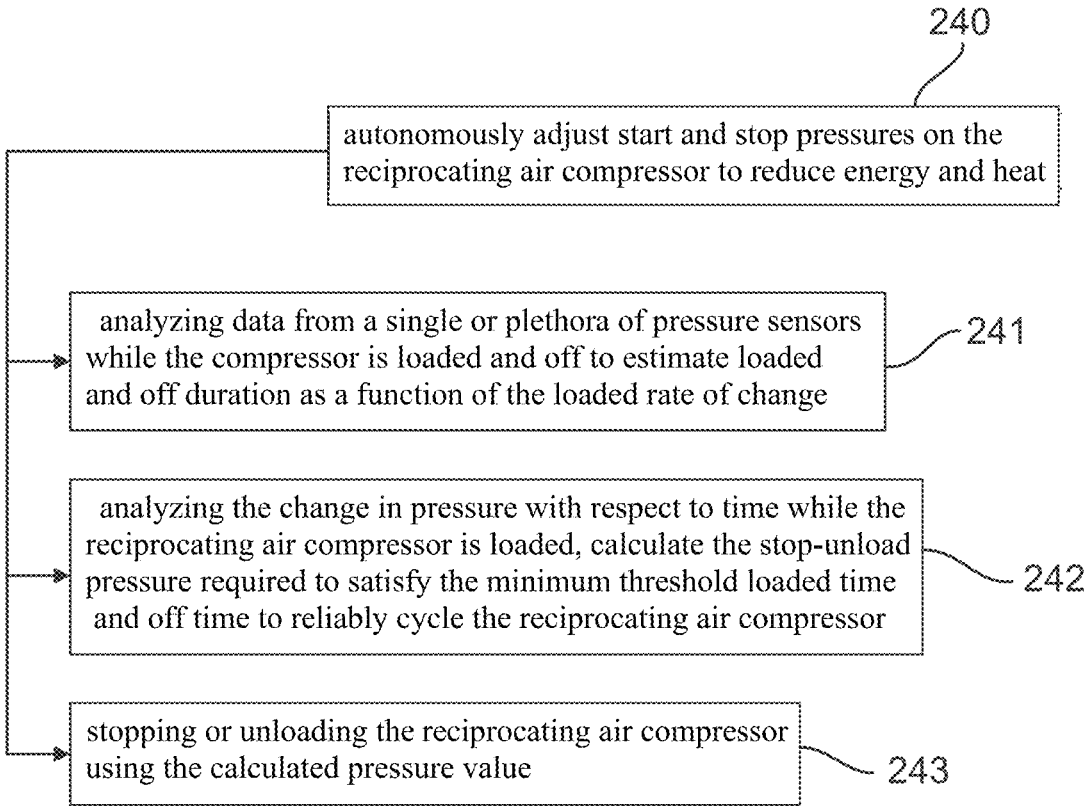
FIG. 10 is a flow chart of the step of autonomously adjusting start and stop pressures on the reciprocating air compressor to reduce energy and heat according to select embodiments of the instant disclosure for the disclosed method of intelligently extending life of a reciprocating air compressor and reducing energy consumption of the reciprocating air compressor.

Referring now specifically to FIG. 10, in select embodiments of method 200 of intelligently extending life of reciprocating air compressor 12 and/or reducing energy consumption of reciprocating air compressor 12, step 240 of autonomously adjusting the start and stop pressures on reciprocating air compressor 12 to reduce energy and heat may include the steps of: step 241 of analyzing data from a single or plethora of pressure sensors while the compressor is loaded and off to estimate loaded and off duration as a function of the loaded rate of change; step 242 of analyzing the change in pressure with respect to time while the reciprocating air compressor is loaded, calculate the stop-unload pressure required to satisfy the minimum threshold loaded time and off time to reliably cycle the reciprocating air compressor; and step 243 of stopping or unloading the reciprocating air compressor using the calculated pressure value.

Figure 11:
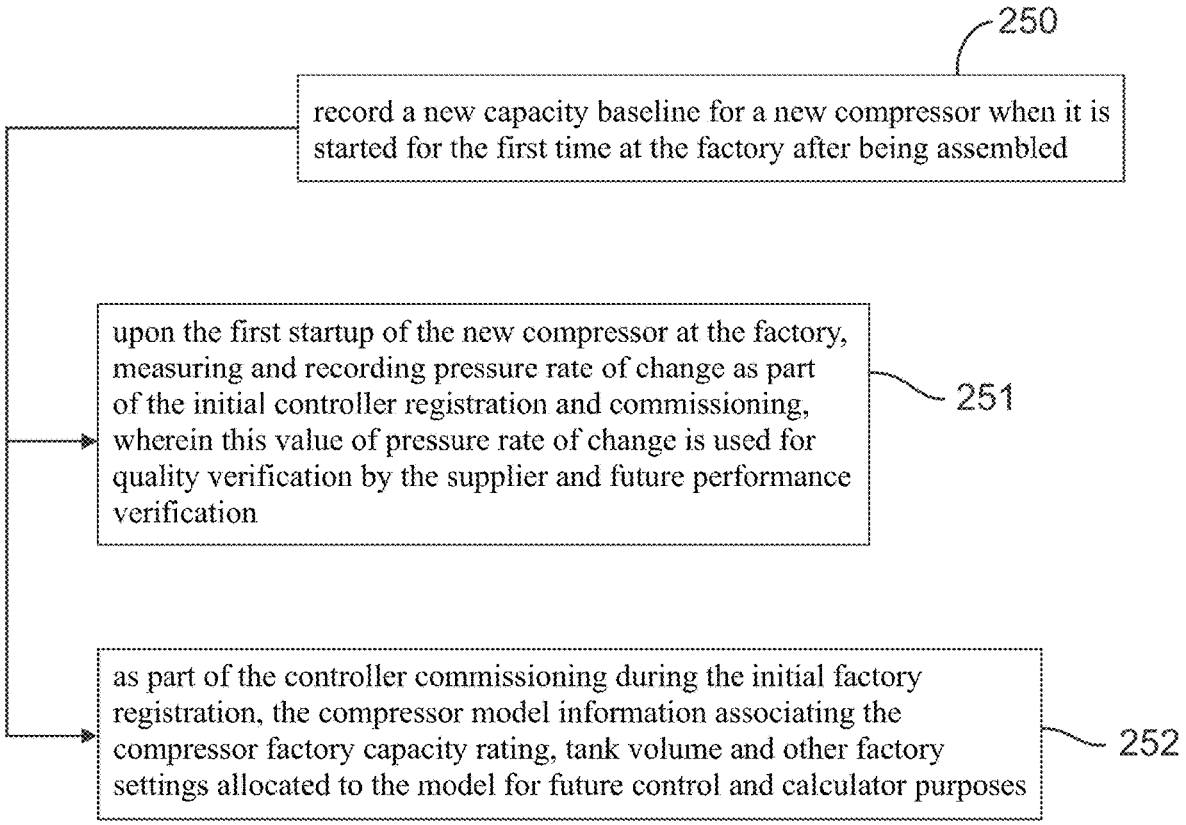
FIG. 11 is a flow chart of the step of recording a new capacity baseline for a new compressor when it is started for the first time at the factory after being assembled according to select embodiments of the instant disclosure for the disclosed method of intelligently extending life of a reciprocating air compressor and reducing energy consumption of the reciprocating air compressor.

Referring now specifically to FIG. 11, in select embodiments of method 200 of intelligently extending life of reciprocating air compressor 12 and/or reducing energy consumption of reciprocating air compressor 12, step 250 of recording the new capacity baseline for the new compressor when it is started for the first time at the factory after being assembled may include the steps of: step 251 of upon the first startup of the new compressor at the factory, measuring and recording pressure rate of change as part of the initial controller registration and commissioning, wherein this value of pressure rate of change is used for quality verification by the supplier and future performance verification; and step 252 as part of the controller commissioning during the initial factory registration, the compressor model information can be validated by associating the compressor factory capacity rating, tank volume and other factory settings allocated to the model for future control and calculator purposes may be included with step 251. Since tank volume and compressor performance data based on model is required for baseline and quality evaluation and should be entered at the factory, the information can be validated or possibly edited during commissioning after installation or any time after.

Figure 12:
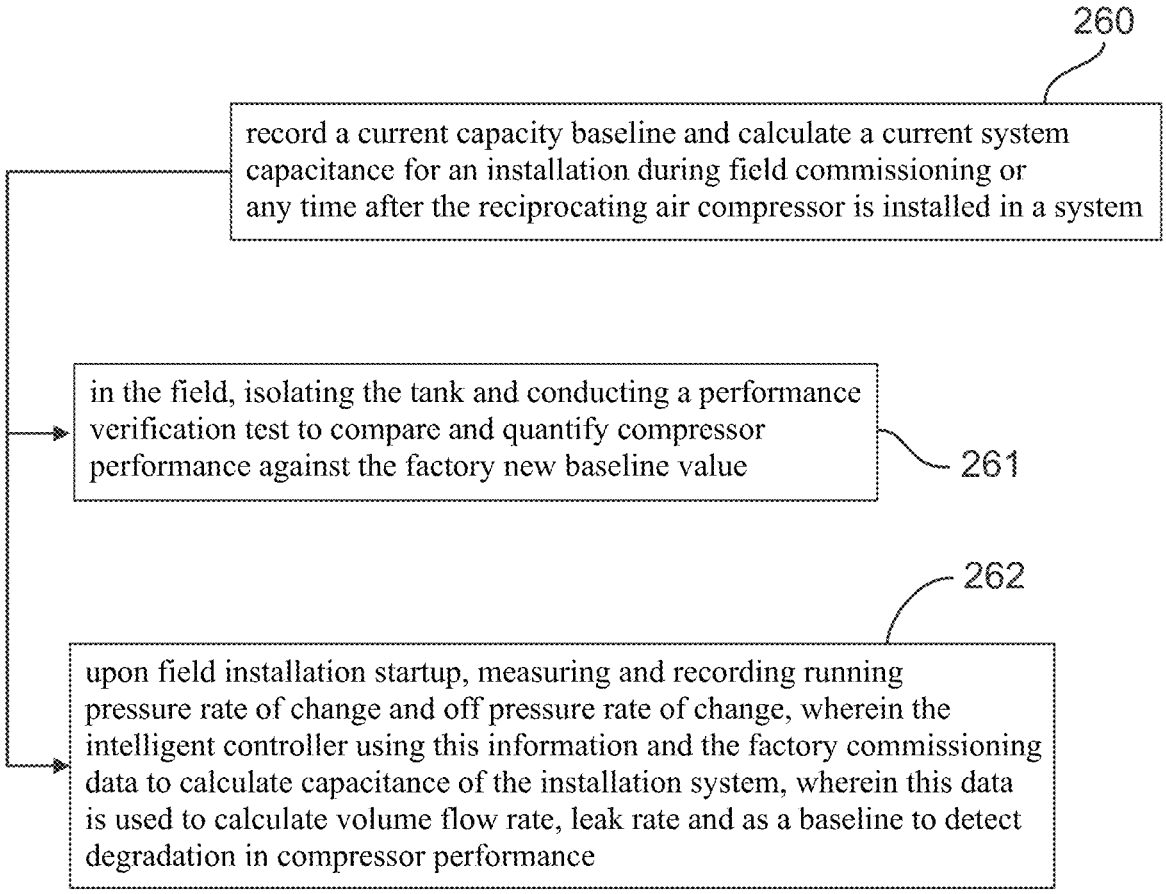
FIG. 12 is a flow chart of the step of recording a current capacity baseline and calculating a current system capacitance for an installation during field commissioning or any time after the reciprocating air compressor is installed in a system according to select embodiments of the instant disclosure for the disclosed method of intelligently extending life of a reciprocating air compressor and reducing energy consumption of the reciprocating air compressor.

Referring now specifically to FIG. 12, in select embodiments of method 200 of intelligently extending life of reciprocating air compressor 12 and/or reducing energy consumption of reciprocating air compressor 12, step 260 of recording the current capacity baseline and calculate the current system capacitance for the installation during field commissioning or any time after the reciprocating air compressor is installed in the system may include the steps of: step 261 of in the field, isolating the tank and conducting a performance verification test to compare and quantify compressor performance against the factory new baseline value; and step 262 of upon field installation startup, measuring and recording running pressure rate of change and off pressure rate of change, wherein the intelligent controller using this information and the factory commissioning data to calculate capacitance of the installation system, wherein this data is used to calculate volume flow rate, leak rate and as a baseline to detect degradation in compressor performance.

Figure 13:
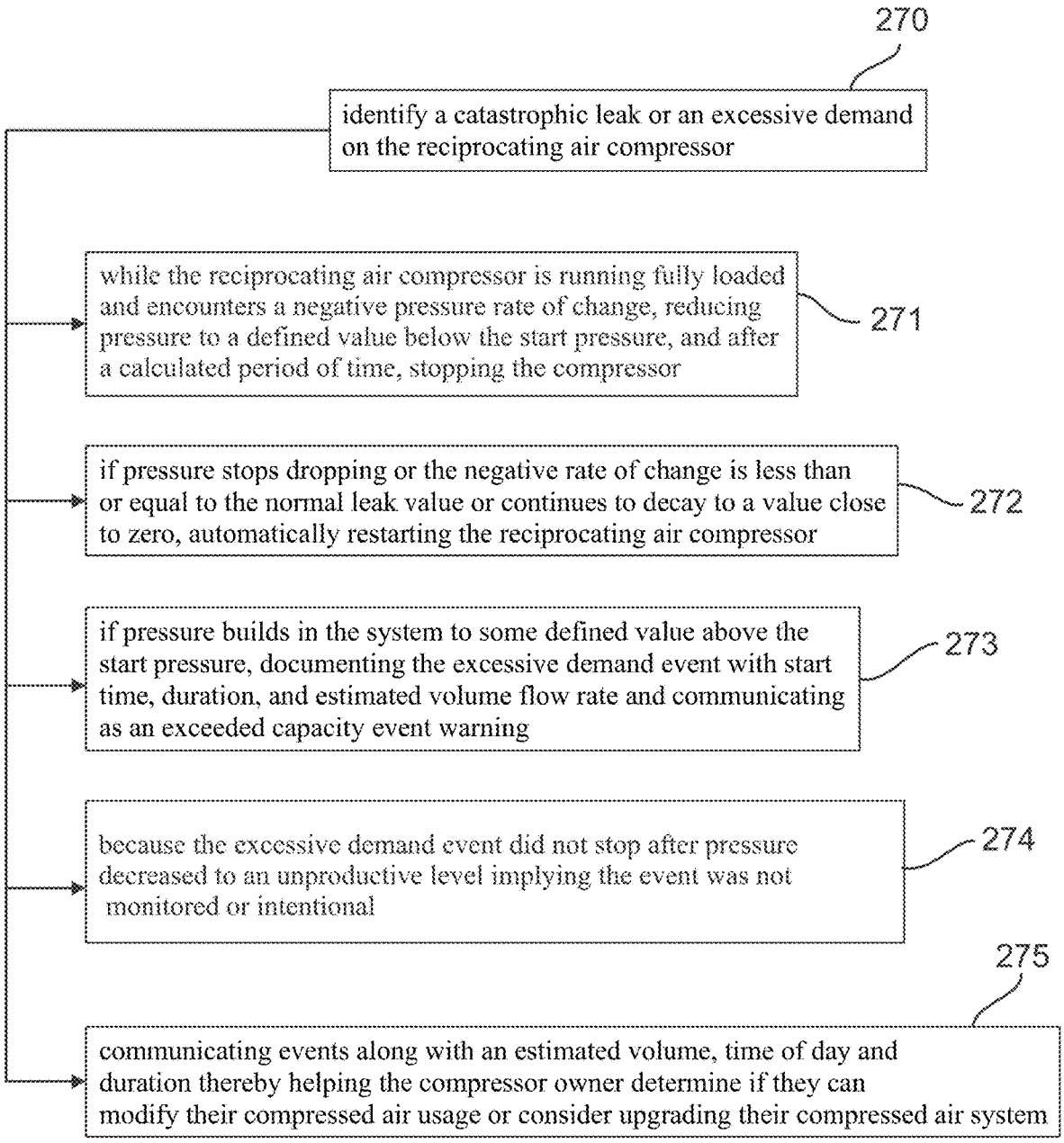
FIG. 13 is a flow chart of the step of identifying a catastrophic leak or an excessive demand on the reciprocating air compressor according to select embodiments of the instant disclosure for the disclosed method of intelligently extending life of a reciprocating air compressor and reducing energy consumption of the reciprocating air compressor.

Referring now specifically to FIG. 13, in select embodiments of method 200 of intelligently extending life of reciprocating air compressor 12 and/or reducing energy consumption of reciprocating air compressor 12, step 270 of identifying a catastrophic leak or an excessive demand on reciprocating air compressor 12 may include the steps of: step 271 of while reciprocating air compressor 12 is running fully loaded and encounters a negative pressure rate of change, reducing pressure to a defined value below the start pressure and after a calculated period of time the compressor is stopped; step 272 of if pressure stops dropping or the negative rate of change is less than or equal to the normal leak value or continues to decay to a value close to zero, automatically restarting reciprocating air compressor 12; step 273 of if pressure builds in the system to some defined value above the start pressure, documenting the excessive demand event with start time, duration, and estimated volume flow rate and communicating as an exceeded capacity event warning (this event data can be logged for statistical analysis, summary communication of these events, etc.); step 274 of if pressure will not recover when the compressor is turned back on, turning off reciprocating air compressor 12 and communicating a catastrophic leak message, wherein it is determined to be a catastrophic leak because the excessive demand event did not stop after pressure decreased to an unproductive level implying the event was not monitored or intentional (A leak will not fix itself after the compressor turns off, then back on again. In the case of an excessive demand, the practical application, e.g., sandblaster, will stop working. The operator will then stop using the compressed air. When the compressor turns back on again, the pressure will increase normally because the excessive demand is no longer "on".); and step 275 of communicating events along with an estimated volume, time of day and duration thereby helping the compressor owner determine if they can modify their compressed air usage or consider upgrading their compressed air system.

Figure 14:
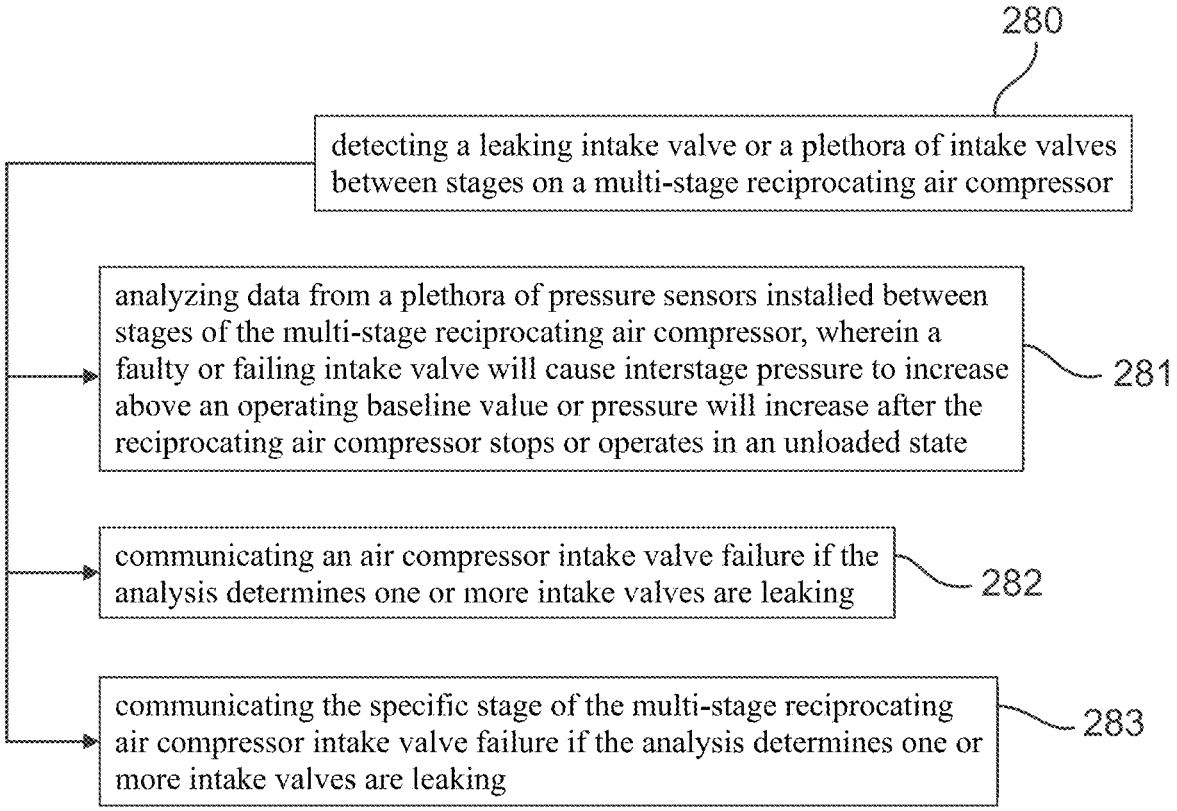
FIG. 14 is a flow chart of the step of detecting leaking intake valve or a plethora of intake valves between stages on a multi-stage reciprocating air compressor according to select embodiments of the instant disclosure for the disclosed method of intelligently extending life of a reciprocating air compressor and reducing energy consumption of the reciprocating air compressor.

Referring now specifically to FIG. 14, in select embodiments of method 200 of intelligently extending life of reciprocating air compressor 12 and/or reducing energy consumption of reciprocating air compressor 12, step 280 of detecting a leaking intake valve or a plethora of intake valves between stages on a multi-stage reciprocating air compressor 12 may include the steps of: step 281 of analyzing data from a plethora of pressure sensors installed between stages of the multi-stage reciprocating air compressor 12, wherein a faulty or failing intake valve will cause interstage pressure to increase above an operating baseline value or pressure will increase after reciprocating air compressor 12 stops or operates in an unloaded state; step 282 of communicating an air compressor intake valve failure if the analysis determines one or more intake valves are leaking; and step 283 of communicating the specific stage of the multi-stage reciprocating air compressor intake valve failure if the analysis determines one or more intake valves are leaking.

Figure 15:
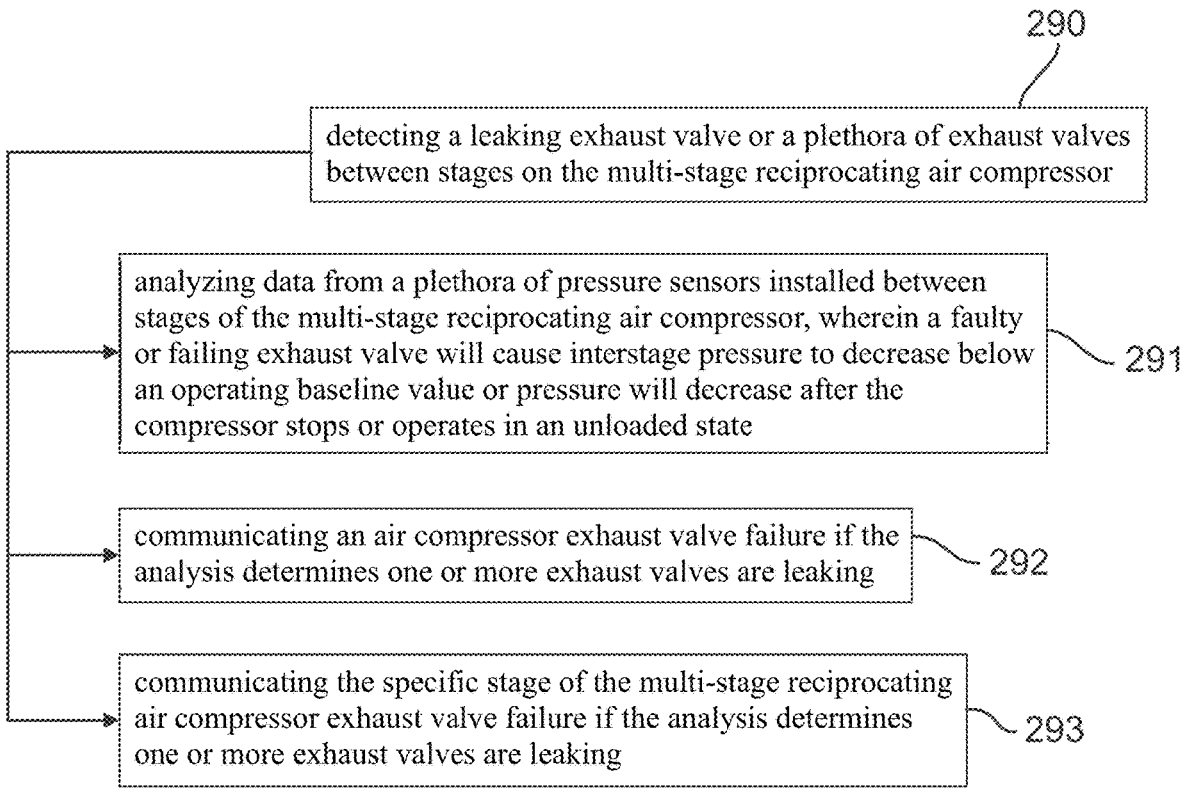
FIG. 15 is a flow chart of the step of detecting a leaking exhaust valve or a plethora of exhaust valves between stages on the multi-stage reciprocating air compressor according to select embodiments of the instant disclosure for the disclosed method of intelligently extending life of a reciprocating air compressor and reducing energy consumption of the reciprocating air compressor.

Referring now specifically to FIG. 15, in select embodiments of method 200 of intelligently extending life of reciprocating air compressor 12 and/or reducing energy consumption of reciprocating air compressor 12, step 290 of detecting a leaking exhaust valve or a plethora of exhaust valves between stages on the multi-stage reciprocating air compressor 12 may include the steps of: step 291 of analyzing data from a plethora of pressure sensors installed between stages of the multi-stage reciprocating air compressor 12, wherein a faulty or failing exhaust valve will cause interstage pressure to decrease below an operating baseline value or pressure will decrease after the compressor stops or operates in an unloaded state; step 292 of communicating an air compressor exhaust valve failure if the analysis determines one or more exhaust valves are leaking; and step 293 of communicating the specific stage of the multi-stage reciprocating air compressor exhaust valve failure if the analysis determines one or more exhaust valves are leaking.

Figure 16:
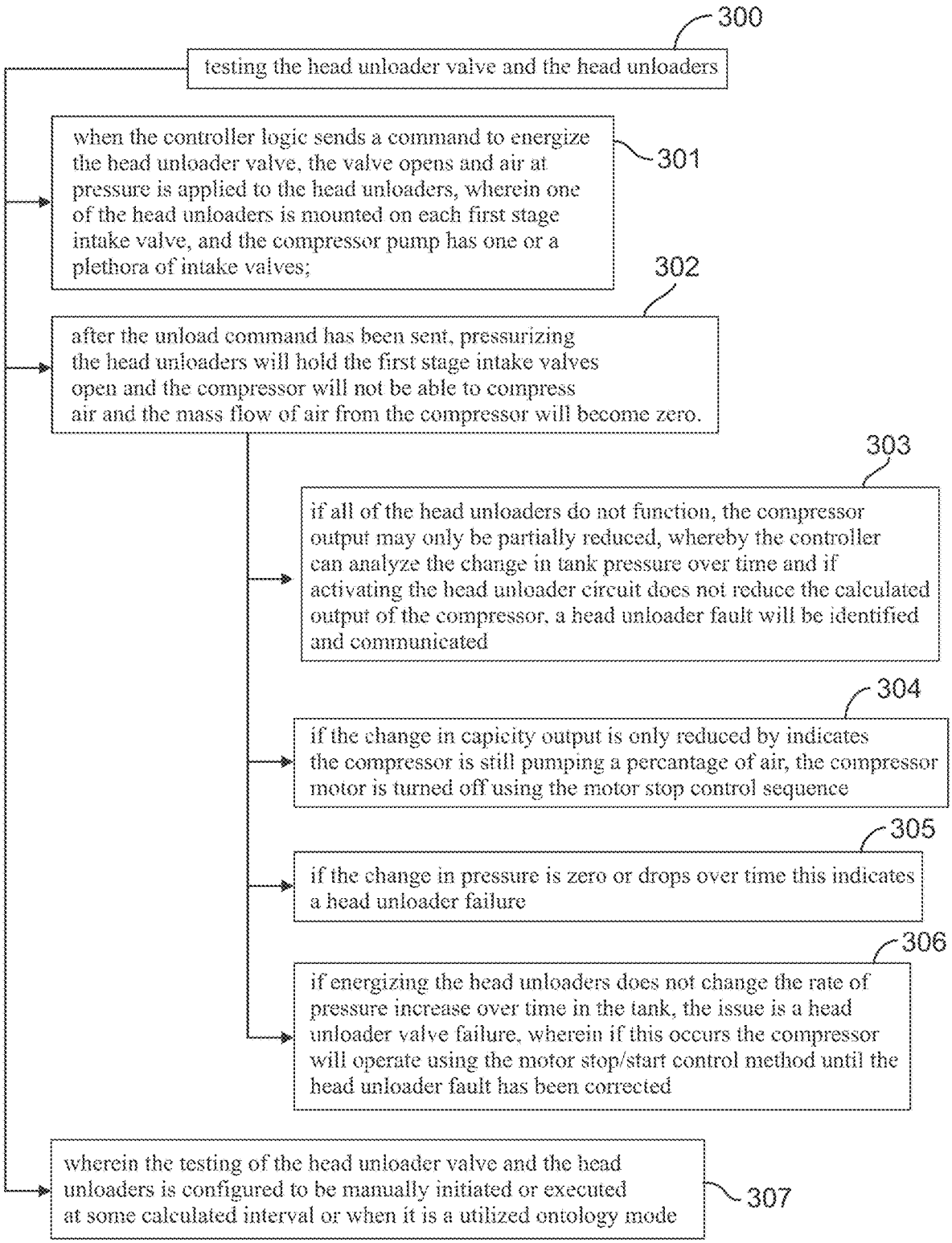
FIG. 16 is a flow chart of the step of testing the head unloader valve and head unloaders according to select embodiments of the instant disclosure for the disclosed method of intelligently extending life of a reciprocating air compressor and reducing energy consumption of the reciprocating air compressor.

Referring now specifically to FIG. 16, in select embodiments of method 200 of intelligently extending life of a reciprocating air compressor 12 and/or reducing energy consumption of reciprocating air compressor 12, step 300 of testing head unloader valve 50 and head unloaders 52 may include the steps of: step 301 of when the controller logic sends a command to energize head unloader valve 50, valve 50 opens and air at pressure is applied to head unloaders 52, wherein one of head unloaders 52 is mounted on each first stage intake valve, and compressor pump 16 has one or a plethora of intake valves; step 302 of after the unload command has been sent, pressurizing head unloaders 52 will hold the first stage intake valves open and compressor 12 will not be able to compress air and the mass flow of air from compressor 12 will become zero, wherein: step 303 of if all of the head unloaders do not function, the compressor output may only be partially reduced, whereby controller 10 can analyze the change in tank pressure over time and if activating the head unloader circuit does not reduce the calculated output of compressor 12, a head unloader fault will be identified and communicated; step 304 of if the change in capacity output is only reduced but indicates compressor 12 is still pumping a percentage of air, compressor motor 18 is turned off using the motor stop control sequence; step 305 of if the change in pressure is zero or drops over time this indicates a head unloader failure; step 306 of if energizing the head unloaders 52 does not change the rate of pressure increase over time in tank 14, the issue is a failure of head unloader valve 50, wherein if this occurs compressor 12 will operate using the motor stop/start control method until the head unloader fault has been corrected; and step 307 of wherein the testing of head unloader valve 50 and head unloaders 52 is configured to be manually initiated or executed at some calculated interval or when it is a utilized control mode.

Figure 17:
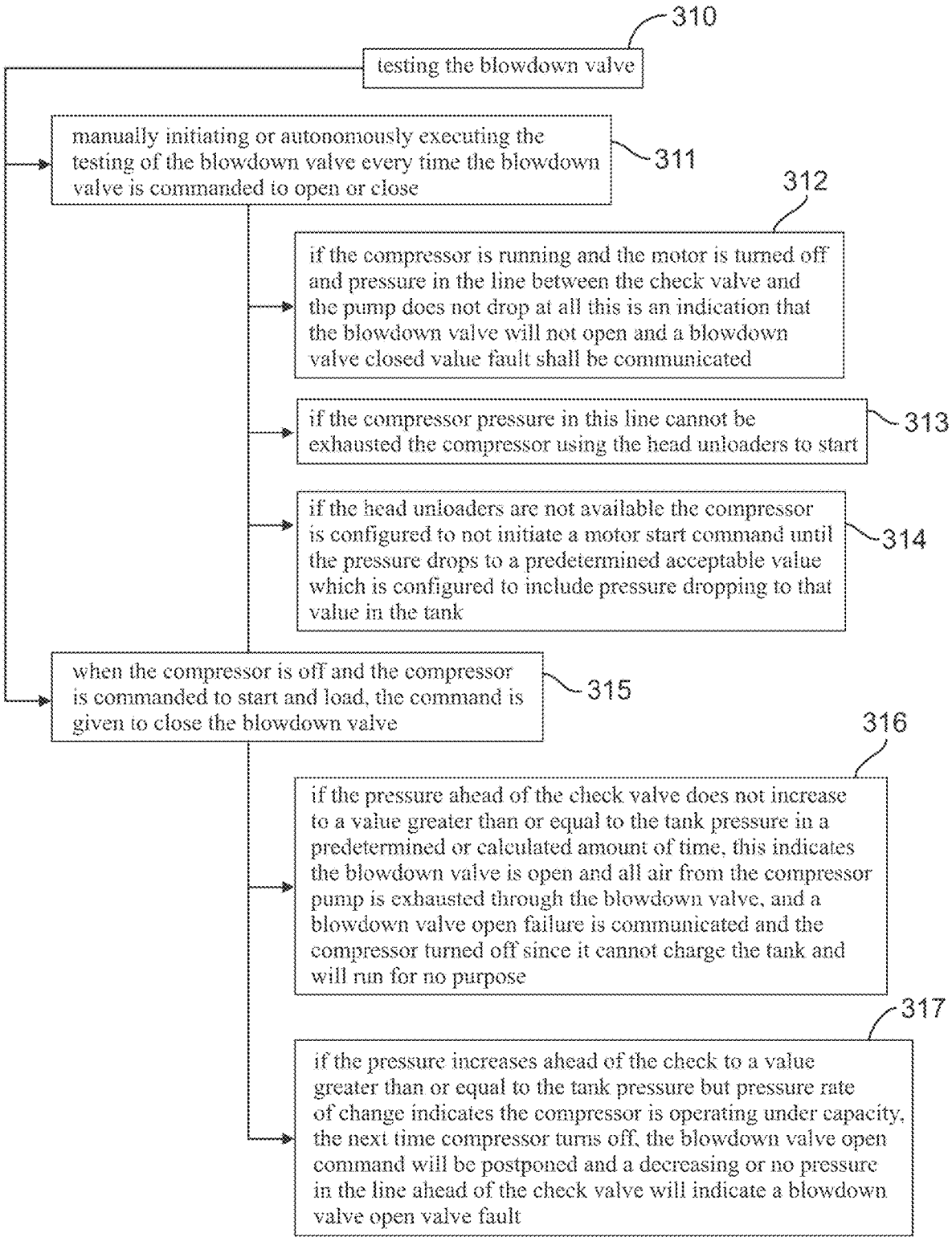
FIG. 17 is a flow chart of the step of testing the blowdown valve according to select embodiments of the instant disclosure for the disclosed method of intelligently extending life of a reciprocating air compressor and reducing energy consumption of the reciprocating air compressor.

Referring now specifically to FIG. 17, in select embodiments of method 200 of intelligently extending life of reciprocating air compressor 12 and/or reducing energy consumption of reciprocating air compressor 12, step 310 of testing blowdown valve 54 may include the steps of: step 311 of manually initiating or autonomously executing the testing of blowdown valve 54 every time blowdown valve 54 is commanded to open or close; wherein: step 312 of if compressor 12 is running and motor 18 is turned off where blowdown valve 54 is signaled/commanded to open and pressure in the line between check valve 22 and pump 16 does not drop at all this is an indication that blowdown valve 54 will not open and a blowdown valve closed valve fault shall be communicated; step 313 of if the compressor pressure in this line cannot be exhausted compressor 12 using head unloaders 52 to start; step 314 of if head unloaders 52 are not available compressor 12 is configured to not initiate a motor start command until the pressure drops to a predetermined acceptable value which is configured to include pressure dropping to that value in tank 14; step 315 of when compressor 12 is off and compressor 12 is commanded to start and load, the command is given to close blowdown valve 54, wherein: step 316 of if the pressure ahead of check valve 22 does not increase to a value greater than or equal to the tank pressure in a predetermined or calculated amount of time, this indicates blowdown valve 54 is open and all air from compressor pump 16 is exhausted through blowdown valve 54, and a blowdown valve open failure is communicated and compressor 12 turned off since it cannot charge tank 14 and will run for no purpose; step 317 of if the pressure increases ahead of check valve 22 to a value greater than or equal to the tank pressure but pressure rate of change indicates compressor 12 is operating under capacity, the next time compressor 12 turns off, blowdown valve open command will be postponed and a decreasing or no pressure in the line ahead of check valve 22 will indicate a blowdown valve open valve fault.

In sum, the disclosed intelligent controller 10 and disclosed method 200 of use thereof are designed and configured to provide a new electronic controller and method for reciprocating air compressors that will extend the life and reduce the energy consumption of such reciprocating air compressors. The disclosed intelligent controller 10 may include unique logic and an electronic control device that has the ability to process input data from connected sensors and external sources. Intelligent controller 10 may have processing capabilities and may be capable of communicating to external sources using wired or wireless methods. Intelligent controller 10 may have output capabilities to control valves, switches, and other devices with an electronic signal. To simplify the installation of intelligent controller 10 on an existing or new reciprocating air compressor 12, intelligent controller 10 and pneumatic inputs (sensors 26) may be incorporated into a single component that is dimensionally similar to a conventional pressure switch (see FIGS. 3-4).

In use, as examples, and clearly not limited thereto: by entering a minimum required pressure, intelligent controller 10 can calculate an optimum start and stop pressure value to maximize compressor efficiency, minimize heat build-up without stressing the motor or compressor; when a check valve fails, intelligent controller will detect the failure, communicate the failure and alter operation to protect the compressor from damage; when an exhaust valve fails, intelligent controller 10 can detect the failure, and communicate the failure; the like; and/or combinations thereof.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. An intelligent controller for a reciprocating air compressor with a tank, an air compressor pump, a motor, a motor starter, a discharge line directly from an exhaust valve of the air compressor pump to the tank, and a check valve in the discharge line, the intelligent controller comprising:

a processor;

a plurality of sensors in communication with the processor, the plurality of sensors is configured to read operating data of the reciprocating air compressor and send the operating data to the processor, the plurality of sensors including:

a tank pressure sensor configured to monitor pressure of air in the tank;

a discharge pressure sensor in the discharge line configured to monitor pressure after the exhaust valve, but before the check valve;

a plurality of peripheral devices in communication with the processor, each of the plurality of peripheral devices is configured to be controlled by the processor, the plurality of peripheral devices is configured to operatively control the reciprocating air compressor; and wherein, the processor is configured to read data from the plurality of sensors and control the plurality of peripheral devices to intelligently extend life of the reciprocating air compressor and reduce energy consumption of the reciprocating air compressor.

2. The intelligent controller of claim 1 being configured to:

calculate an optimum start and stop pressure value to maximize compressor efficiency, and minimize heat buildup without stressing the motor or the air compressor pump based on an entered minimum required pressure;

detect a failure of the check valve and communicate the failure of the check valve and alter operation to protect the reciprocating air compressor from damage;

detect a failure of an exhaust valve and communicate the failure of the exhaust valve;

utilize the operating data of the reciprocating air compressor to diagnose subassembly or component degradation or failure and communicate the component failure to a user, and if required, limiting air compressor operation to prevent a catastrophic failure;

control the reciprocating air compressor to extend the life of the reciprocating air compressor by identifying hazardous operating conditions and warning the user, and if required, limiting compressor function to protect the reciprocating air compressor from the catastrophic failure;

improve efficiency and reliability of the reciprocating air compressor by adjusting control methods via the processor based on contextual decisions to deliver a desired pressure without over pressurizing the reciprocating air compressor or cycling the motor and the air compressor pump excessively; or combinations thereof.

3. The intelligent controller of claim 1, wherein the processor is configured to use a number of networking protocols to obtain a network connection via wired or wireless communication to communicate the operating data of the reciprocating air compressor from any of the plurality of sensors, wherein the processor is configured to make decisions to control the reciprocating air compressor with or without the network connection.

4. The intelligent controller of claim 3, whereby the operating data from the plurality of sensors can be displayed by the processor to a user through a graphical interface.

5. The intelligent controller of claim 1, wherein the processor is configured to communicate with the plurality of sensors and the plurality of peripheral devices via wired communication lines or wireless communication lines.

6. The intelligent controller of claim 1, wherein:

the plurality of sensors including:

at least one interstage pressure sensor, each of the at least one interstage pressure sensor is configured to monitor pressure between stages of compression;

the plurality of peripheral devices including:

a head unloader valve configured to energize or de-energize head loaders for unloaded operation; and a blowdown valve configured to discharge air between the exhaust valve of the final state and the check valve going into the tank.

7. The intelligent controller of claim 6, wherein:

the plurality of sensors further including:

an oil pressure sensor configured to monitor oil pressure;

an air intake pressure sensor configured to monitor pressure at an inlet of a first stage;

an air intake differential pressure sensor configured to monitor pressure loss across an intake filter;

a valve temperature sensor, the valve temperature sensor is configured to measure surface temperature of the exhaust valve or the intake valve;

a regulated pressure sensor positioned after a tank pressure regulator, the regulated pressure sensor is configured to monitor the pressure of air exiting the tank pressure regulator;

an oil level sensor being a float type device sensor configured to monitor a level of oil in the air compressor pump to protect from low oil levels;

the plurality of peripheral devices further including:

the tank pressure regulator configured to control pressure exiting the tank, the tank pressure regulator is configured to be manually controlled or digitally controlled;

a tank drain valve configured to drain condensate from the tank;

a tank discharge isolation valve being an electronically controlled valve at a discharge of the tank, the tank discharge isolation valve is configured to isolate a distribution network of piping and hose exiting the tank; and a relay being an electronic on-off switch configured to control power to a starter.

8. The intelligent controller of claim 1, wherein the intelligent controller for the reciprocating air compressor including a housing configured to house the processor.

9. The intelligent controller of claim 8, wherein the housing is configured to further house the plurality of sensors and the plurality of peripheral devices; and wherein the housing is sized similar to a conventional pressure switch size.

10. The intelligent controller of claim 8, wherein the housing including:

a manifold assembly including an internal passage configured to support multiple ports all connected to the tank, the multiple ports connecting the processor to a head unloader valve, a gauge, a pressure relief valve and a discharge port;

a threaded connection point on a bottom or a side of the housing, the threaded connection point being a standard pipe thread configured to mount to a pipe nipple on the tank; and wherein, the manifold assembly is configured to supply air to the tank and the head unloader valve through a head unloader solenoid valve.

11. The intelligent controller of claim 10, wherein the manifold assembly including a second passage connected to a compressor side of the check valve, the second passage is configured to connect the processor with a pressure transducer and a blowdown valve.

12. The intelligent controller of claim 1, wherein the intelligent controller is powered by a dedicated power supply or from a compressor supply power, wherein a switch incorporates a relay with main power being supplied to the motor through the intelligent controller or has an electronic signal or a power supply to turn the motor on and off using a magnetic starter.

13. The intelligent controller of claim 1, wherein the intelligent controller is configured to:

detect a faulty check valve on the reciprocating air compressor;

detect a leaking exhaust valve or a plethora of leaking exhaust valves on the reciprocating air compressor;

protect the reciprocating air compressor motor from failing prematurely;

autonomously adjust start and stop pressures on the reciprocating air compressor to reduce energy and heat;

record a new capacity baseline for a new compressor when it is started for the first time at the factory after being assembled;

record a current capacity baseline and calculate a current system capacitance for an installation during field commissioning or any time after the reciprocating air compressor is installed in a system;

identify a catastrophic leak or an excessive demand on the reciprocating air compressor;

detecting a leaking intake valve on the reciprocating air compressor or a plethora of leaking intake valves between stages on the reciprocating air compressor when the reciprocating air compressor is a multi-stage reciprocating air compressor;

detecting the leaking exhaust valve on the reciprocating air compressor or the plethora of leaking exhaust valves between stages on the reciprocating air compressor when the reciprocating air compressor is the multi-stage reciprocating air compressor;

testing a head unloader valve and head unloaders;

testing a blowdown valve;

or combinations thereof.

14. An intelligent controller for a multi-stage reciprocating air compressor with a tank, an air compressor pump, a motor, a motor starter, and a check valve, the intelligent controller comprising:

a processor;

a plurality of sensors in communication with the processor, the plurality of sensors is configured to read operating data of the multi-stage reciprocating air compressor and send the operating data to the processor, the plurality of sensors including:

at least one interstage pressure sensor, each of the at least one interstage pressure sensor is configured to monitor pressure between stages of compression;

a tank pressure sensor configured to monitor pressure of air in the tank;

a final discharge pressure sensor configured to monitor pressure after an exhaust valve of a final stage, but before the check valve;

an oil pressure sensor configured to monitor oil pressure;

an air intake pressure sensor configured to monitor pressure at an inlet of a first stage;

an air intake differential pressure sensor configured to monitor pressure loss across an intake filter;

a valve temperature sensor, the valve temperature sensor is configured to measure a surface temperature of the exhaust valve or an intake valve;

a regulated pressure sensor positioned after a tank pressure regulator, the regulated pressure sensor is configured to monitor the pressure of air exiting the tank pressure regulator;

an oil level sensor being a float type device sensor to monitor a level of oil in the air compressor pump to protect from low oil levels;

a plurality of peripheral devices in communication with the processor, each of the plurality of peripheral devices is configured to be controlled by the processor, the plurality of peripheral devices is configured to operatively control the multi-stage reciprocating air compressor, the plurality of peripheral devices including:

an unloader valve configured to energize or de-energize head unloaders for unloaded operation;

a blowdown valve configured to discharge air between the exhaust valve of the final stage and the check valve going into the tank;

the tank pressure regulator configured to control pressure exiting the tank, the tank pressure regulator is configured to be manually controlled or digitally controlled;

a tank drain valve configured to drain condensate from the tank;

a tank discharge isolation valve being an electronically controlled valve at a discharge of the tank, the tank discharge isolation valve is configured to isolate a distribution network of piping and hose exiting the tank;

a relay being an electronic on-off switch configured to control power to a starter;

the processor is configured to use a number of networking protocols to obtain a network connection via wired or wireless communication to communicate the operating data of the multi-stage reciprocating air compressor from any of the plurality of sensors, wherein the processor is configured to make decisions to control the multi-stage reciprocating air compressor with or without the network connection;

the operating data from the plurality of sensors can be displayed by the processor to a user through a graphical interface;

the processor is configured to communicate with the plurality of sensors and the plurality of peripheral devices via wired communication lines or wireless communication lines;

wherein, the processor is configured to read data from the plurality of sensors and control the plurality of peripheral devices to intelligently extend life of the multi-stage reciprocating air compressor and reduce energy consumption of the multi-stage reciprocating air compressor;

a housing configured to house the processor, the plurality of sensors, and the plurality of peripheral devices, the housing is sized similar to a conventional pressure switch size, wherein the housing including:

a manifold assembly including an internal passage configured to support multiple ports all connected to the tank, the multiple ports connecting the processor to a head unloader valve, a gauge, a pressure relief valve and a discharge port;

a threaded connection point on a bottom or a side of the housing, the threaded connection point being a standard pipe thread configured to mount to a pipe nipple on the tank;

wherein, the manifold assembly is configured to supply air to the tank and the head unloader valve through a head unloader solenoid valve;

the manifold assembly including a second passage connected to a compressor side of the check valve, the second passage is configured to connect the processor with a pressure transducer and a blowdown valve;

wherein the intelligent controller is powered by a dedicated power supply or from a compressor supply power, wherein a switch incorporates a relay with main power being supplied to the motor through the intelligent controller or has an electronic signal or a power supply to turn the motor on and off using a magnetic starter;

wherein, the intelligent controller is configured to:

calculate an optimum start and stop pressure value to maximize compressor efficiency, and minimize heat buildup without stressing the motor or the air compressor pump based on an entered minimum required pressure;

detect a failure of the check valve and communicate the failure of the check valve and alter operation to protect the multi-stage reciprocating air compressor from damage;

detect a failure of a failing exhaust valve and communicate the failure of the failing exhaust valve;

utilize the operating data of the multi-stage reciprocating air compressor to diagnose subassembly or component degradation or failure and communicate the component failure to the user, and if required, limiting air compressor operation to prevent a catastrophic failure;

control the multi-stage reciprocating air compressor to extend the life of the multi-stage reciprocating air compressor by identifying hazardous operating conditions and warning the user, and if required, limiting compressor function to protect the multi-stage reciprocating air compressor from the catastrophic failure; and improve efficiency and reliability of the multi-stage reciprocating air compressor by adjusting control methods via the processor based on contextual decisions to deliver a desired pressure without over pressurizing the multi-stage reciprocating air compressor or cycling the motor and the air compressor pump excessively;

wherein the intelligent controller is configured to:

detecting a faulty check valve on the multi-stage reciprocating air compressor;

detecting a leaking exhaust valve or a plethora of leaking exhaust valves on the multi-stage reciprocating air compressor;

protect the multi-stage reciprocating air compressor motor from failing prematurely;

autonomously adjust start and stop pressures on the multi-stage reciprocating air compressor to reduce energy and heat;

record a new capacity baseline for a new compressor when it is started for the first time at the factory after being assembled;

record a current capacity baseline and calculate a current system capacitance for an installation during field commissioning or any time after the multi-stage reciprocating air compressor is installed in a system;

identify a catastrophic leak or an excessive demand on the multi-stage reciprocating air compressor;

detecting a leaking intake valve or a plethora of leaking intake valves between stages on the multi-stage reciprocating air compressor;

detecting the leaking exhaust valve or the plethora of leaking exhaust valves between stages on the multi-stage reciprocating air compressor;

testing the head unloader valve and the head unloaders; and testing the blowdown valve.

15. A method of intelligently extending life of a reciprocating air compressor and reducing energy consumption of the reciprocating air compressor comprising:

providing an intelligent controller for the reciprocating air compressor with a tank, an air compressor pump, a motor, a motor starter, a discharge line directly from an exhaust valve of the air compressor pump to the tank, and a check valve in the discharge line, the intelligent controller comprising:

a processor;

a plurality of sensors in communication with the processor, the plurality of sensors is configured to read operating data of the reciprocating air compressor and send the operating data to the processor, the plurality of sensors including:

a tank pressure sensor configured to monitor pressure of air in the tank;

a discharge pressure sensor in the discharge line configured to monitor pressure after the exhaust valve, but before the check valve;

a plurality of peripheral devices in communication with the processor, each of the plurality of peripheral devices is configured to be controlled by the processor, the plurality of peripheral devices is configured to operatively control the reciprocating air compressor;

installing the intelligent controller on the reciprocating air compressor;

reading data from the plurality of sensors; and controlling the plurality of peripheral devices to intelligently extend life of the reciprocating air compressor and reduce energy consumption of the reciprocating air compressor.

16. The method of claim 15, wherein the controlling the plurality of peripheral devices to intelligently extend life of the reciprocating air compressor and reduce energy consumption of the reciprocating air compressor including:

calculating an optimum start and stop pressure value to maximize compressor efficiency, and minimize heat buildup without stressing the motor or the air compressor pump based on an entered minimum required pressure;

detecting a failure of the check valve and communicating the failure of the check valve and alter operation to protect the reciprocating air compressor from damage;

detecting a failure of a failing exhaust valve and communicating the failure of the failing exhaust valve;

utilizing the operating data of the reciprocating air compressor to diagnose subassembly or component degradation or failure and communicating the component failure to a user, and if required, limiting air compressor operation to prevent a catastrophic failure;

controlling the reciprocating air compressor to extend the life of the reciprocating air compressor by identifying hazardous operating conditions and warning the user, and if required, limiting compressor function to protect the reciprocating air compressor from the catastrophic failure;

improving efficiency and reliability of the reciprocating air compressor by adjusting control methods via the processor based on contextual decisions to deliver a desired pressure without over pressurizing the reciprocating air compressor or cycling the motor and the air compressor pump excessively; or combinations thereof.

17. The method of claim 16, wherein the reciprocating air compressor is a multi-stage reciprocating air compressor, wherein, the plurality of sensors further including:

at least one interstage pressure sensor, each of the at least one interstage pressure sensor is configured to monitor pressure between stages of compression;

an oil pressure sensor configured to monitor oil pressure;

an air intake pressure sensor configured to monitor pressure at an inlet of a first stage;

an air intake differential pressure sensor configured to monitor pressure loss across an intake filter;

a valve temperature sensor, the valve temperature sensor is configured to measure a surface temperature of the exhaust valve or the intake valve;

a regulated pressure sensor positioned after a tank pressure regulator, the regulated pressure sensor is configured to monitor the pressure of air exiting the tank pressure regulator;

an oil level sensor being a float type device sensor to monitor a level of oil in the air compressor pump to protect from low oil levels;

the plurality of peripheral devices including:

a head unloader valve configured to energize or de-energize head unloaders for unloaded operation;

a blowdown valve configured to discharge air between the exhaust valve of the final stage and the check valve going into the tank;

the tank pressure regulator configured to control pressure exiting the tank, the tank pressure regulator is configured to be manually controlled or digitally controlled;

a tank drain valve configured to drain condensate from the tank;

a tank discharge isolation valve being an electronically controlled valve at a discharge of the tank, the tank discharge isolation valve is configured to isolate a distribution network of piping and hose exiting the tank; and a relay being an electronic on-off switch configured to control power to a starter.

18. The method of claim 17, wherein the controlling the plurality of peripheral devices to intelligently extend life of the multi-stage reciprocating air compressor and reduce energy consumption of the multi-stage reciprocating air compressor including:

detecting a faulty check valve on the multi-stage reciprocating air compressor;

detecting a leaking exhaust valve or a plethora of leaking exhaust valves on the multi-stage reciprocating air compressor;

protecting the multi-stage reciprocating air compressor motor from failing prematurely;

autonomously adjusting start and stop pressures on the multi-stage reciprocating air compressor to reduce energy and heat;

recording a new capacity baseline for a new compressor when it is started for the first time at the factory after being assembled;

recording a current capacity baseline and calculate a current system capacitance for an installation during field commissioning or any time after the multi-stage reciprocating air compressor is installed in a system;

identifying a catastrophic leak or an excessive demand on the multi-stage reciprocating air compressor;

detecting a leaking intake valve or a plethora of intake valves between stages on the multi-stage reciprocating air compressor;

detecting the leaking exhaust valve or the plethora of leaking exhaust valves between stages on the multi-stage reciprocating air compressor;

testing the head unloader valve and the head unloaders;

testing the blowdown valve;

or combinations thereof.

19. The method of claim 17, wherein the controlling the plurality of peripheral devices to intelligently extend life of the multi-stage reciprocating air compressor and reduce energy consumption of the multi-stage reciprocating air compressor including:

detecting a faulty check valve on the multi-stage reciprocating air compressor;

detecting a leaking exhaust valve or a plethora of leaking exhaust valves on the multi-stage reciprocating air compressor;

protecting the multi-stage reciprocating air compressor motor from failing prematurely;

autonomously adjusting start and stop pressures on the multi-stage reciprocating air compressor to reduce energy and heat;

recording a new capacity baseline for a new compressor when it is started for the first time at the factory after being assembled;

recording a current capacity baseline and calculate a current system capacitance for an installation during field commissioning or any time after the multi-stage reciprocating air compressor is installed in a system;

identifying a catastrophic leak or an excessive demand on the multi-stage reciprocating air compressor;

detecting a leaking intake valve or a plethora of intake valves between stages on the multi-stage reciprocating air compressor;

detecting the leaking exhaust valve or the plethora of leaking exhaust valves between stages on the multi-stage reciprocating air compressor;

testing the head unloader valve and the head unloaders; and testing the blowdown valve.

20. The method of claim 19, wherein:

the detecting the faulty check valve on the multi-stage reciprocating air compressor including:

stopping or unloading the multi-stage reciprocating air compressor;

opening an electronically controlled valve to exhaust air from the discharge of the air compressor ahead of a check valve;

analyzing data from a pressure sensor installed on the line between the air compressor discharge and the check valve, calculate and save time required to reduce pressure in the line to a safe start pressure for the air compressor wherein this data is used to determine when to initiate the compressor start sequence;

closing the electronically controlled valve after a predetermined or calculated period of time;

analyzing data from a pressure sensor installed on the line between the air compressor discharge and the check valve to identify air leaking past the check valve;

communicating a check valve failure if the analysis determines the check valve is leaking;

keeping the electronically controlled valve closed to prevent the compressed air leaking past the check valve from exhausting to the atmosphere saving energy by not wasting stored compressed air; and analyzing data from a pressure sensor installed on the tank circuit to calculate when to initiate a compressor start sequence so the compressor can safely start before pressure decays to a value less than a defined minimum pressure setting;

the detecting the leaking exhaust valve or the plethora of leaking exhaust valves on the multi-stage reciprocating air compressor comprising:

stopping or unloading the multi-stage reciprocating air compressor;

keeping the blowdown valve in a closed state to not evacuate air from a discharge line of the air compressor;

analyzing data from a pressure sensor installed on the line between the air compressor discharge and the check valve to identify the leaking exhaust valve;

communicating an air compressor exhaust valve failure if the analysis determines one or more exhaust valves are leaking;

if pressure decays to a value close to zero or less than the tank pressure this indicates the check valve is holding but the air has leaked past the exhaust valves and out through the crank case vent or intake valves if they are also leaking;

evaluating exhaust valve leakage including trending compressor capacity by rate of pressure change with respect to time and also by monitoring discharge temperature, thereby increasing confidence in the failure diagnosis or evaluating severity; and if pressure tracks with the tank pressure, communicating the exhaust valves are holding and working fine;

the protecting the multi-stage reciprocating air compressor motor from failing prematurely including:

analyzing data from a pressure sensor while the multi-stage reciprocating air compressor is loaded to estimate the time the motor will be off after reaching the stop pressure target;

analyzing the multi-stage reciprocating air compressor motor design data, loaded time, possibly pressure, possibly temperature, and possibly motor age to estimate a minimum safe motor off duration;

deciding to unload the multi-stage reciprocating air compressor or stop the motor by comparing the estimated time the motor will be off after reaching the stop pressure target with the calculated minimum safe motor off duration; and deciding to temporarily raise the motor stop pressure setting to extend the calculated off time to protect the motor if the air compressor is not capable of unloading the compressor pump while keeping the motor on;

the autonomously adjusting the start and stop pressures on the multi-stage reciprocating air compressor to reduce energy and heat including;

analyzing data from a single or plethora of pressure sensors while the compressor is loaded and off to estimate loaded and off duration as a function of the loaded rate of change;

analyzing the change in pressure with respect to time while the multi-stage reciprocating air compressor is loaded, calculate the stop-unload pressure required to satisfy the minimum threshold loaded time and off time to reliably cycle the multi-stage reciprocating air compressor; and stopping or unloading the multi-stage reciprocating air compressor using the calculated pressure value;

the recording the new capacity baseline for the new compressor when it is started for the first time at the factory after being assembled including;

upon the first startup of the new compressor at the factory, measuring and recording pressure rate of change as part of the initial controller registration and commissioning, wherein this value of pressure rate of change is used for quality verification by the supplier and future performance verification; and as part of the controller commissioning during the initial factory registration, the compressor model information is validated by associating the compressor factory capacity rating, tank volume and other factory settings allocated to the model for future control and calculator purposes;

the recording the current capacity baseline and calculate the current system capacitance for the installation during field commissioning or any time after the multi-stage reciprocating air compressor is installed in the system including;

in the field, isolating the tank and conducting a performance verification test to compare and quantify compressor performance against the factory new baseline value; and upon field installation startup, measuring and recording running pressure rate of change and off pressure rate of change, wherein the intelligent controller using this information and the factory commissioning data to calculate capacitance of the installation system, wherein this data is used to calculate volume flow rate, leak rate and as a baseline to detect degradation in compressor performance;

the identifying a catastrophic leak or an excessive demand on the multi-stage reciprocating air compressor including:

while the multi-stage reciprocating air compressor is running fully loaded and encounters a negative pressure rate of change, reducing pressure to a defined value below the start pressure and for a calculated period of time the compressor is stopped;

if pressure stops dropping or the negative rate of change is less than or equal to the normal leak value or continues to decay to a value close to zero, automatically restarting the multi-stage reciprocating air compressor;

if pressure builds in the system to some defined value above the start pressure, documenting the excessive demand event with start time, duration, and estimated volume flow rate and communicating as an exceeded capacity event warning;

if pressure will not recover when the compressor is turned back on, turning off the multi-stage reciprocating air compressor and communicating a catastrophic leak message, wherein it is determined to be a catastrophic leak because the excessive demand event did not stop after pressure decreased to an unproductive level implying the event was not monitored or intentional;

communicating events along with an estimated volume, time of day and duration thereby helping the compressor owner determine if they can modify their compressed air usage or consider upgrading their compressed air system;

the detecting a leaking intake valve or a plethora of intake valves between stages on the multi-stage reciprocating air compressor including:

analyzing data from a plethora of pressure sensors installed between stages of the multi-stage reciprocating air compressor, wherein a faulty or failing intake valve will cause interstage pressure to increase above an operating baseline value or pressure will increase after the multi-stage reciprocating air compressor stops or operates in an unloaded state;

communicating an air compressor intake valve failure if the analysis determines one or more intake valves are leaking;

communicating the specific stage of the multi-stage reciprocating air compressor intake valve failure if the analysis determines one or more intake valves are leaking;

the detecting the leaking exhaust valve or the plethora of leaking exhaust valves between stages on the multi-stage reciprocating air compressor including:

analyzing data from a plethora of pressure sensors installed between stages of the multi-stage reciprocating air compressor, wherein a faulty or failing exhaust valve will cause interstage pressure to decrease below an operating baseline value or pressure will decrease after the compressor stops or operates in an unloaded state;

communicating an air compressor exhaust valve failure if the analysis determines one or more exhaust valves are leaking;

communicating the specific stage of the multi-stage reciprocating air compressor exhaust valve failure if the analysis determines one or more exhaust valves are leaking;

the testing the head unloader valve and the head unloaders including:

when the controller logic sends a command to energize the head unloader valve, the valve opens and air at pressure is applied to the head unloaders, wherein one of the head unloaders is mounted on each first stage intake valve, and the compressor pump has one or a plethora of intake valves;

after the unload command has been sent, pressurizing the head unloaders will hold the first stage intake valves open and the compressor will not be able to compress air and the mass flow of air from the compressor will become zero, wherein:

if all of the head unloaders do not function, the compressor output may only be partially reduced, whereby the controller can analyze the change in tank pressure over time and if activating the head unloader circuit does not reduce the calculated output of the compressor, a head unloader fault will be identified and communicated;

if the change in capacity output is only reduced but indicates the compressor is still pumping a percentage of air, the compressor motor is turned off using the motor stop control sequence;

if the change in pressure is zero or drops over time this indicates a head unloader failure;

if energizing the head unloaders does not change the rate of pressure increase over time in the tank, the issue is a head unloader valve failure, wherein if this occurs the compressor will operate using the motor stop/start control method until the head unloader fault has been corrected;

wherein the testing of the head unloader valve and the head unloaders is configured to be manually initiated or executed at some calculated interval or when it is a utilized control mode; and the testing the blowdown valve including:

manually initiating or autonomously executing the testing of the blowdown valve every time the blowdown valve is commanded to open or close;

wherein:

if the compressor is running and the motor is turned off and pressure in the line between the check valve and the pump does not drop at all this is an indication that the blowdown valve will not open and a blowdown valve closed valve fault shall be communicated;

if the compressor pressure in this line cannot be exhausted the compressor is started using the head unloaders;

if the head unloaders are not available the compressor is configured to not initiate a motor start command until the pressure drops to a predetermined acceptable value which is configured to include pressure dropping to that value in the tank;

when the compressor is off and the compressor is commanded to start and load, the command is given to close the blowdown valve, wherein:

if the pressure ahead of the check valve does not increase to a value greater than or equal to the tank pressure in a predetermined or calculated amount of time, this indicates the blowdown valve is open and all air from the compressor pump is exhausted through the blowdown valve, and a blowdown valve open failure is communicated and the compressor turned off since it cannot charge the tank and will run for no purpose;

if the pressure increases ahead of the check valve to a value greater than or equal to the tank pressure but pressure rate of change indicates the compressor is operating under capacity, the next time compressor turns off, the blowdown valve open command will be postponed and a decreasing or no pressure in the line ahead of the check valve will indicate a blowdown valve open valve fault.

* * * * *